US005309518A

United States Patent [19]

Ickler et al.

[11] Patent Number: 5,309,518

[45] Date of Patent: May 3, 1994

[54] MULTIPLE DRIVER ELECTROACOUSTICAL TRANSDUCING

[75] Inventors: Christopher B. Ickler, Sudbury; Morten Jorgensen, Cambridge; Kenneth D. Jacob, Saxonville; Seiji Kawakami, Natick, all of Mass.

[73] Assignee: Bose Corporation, Framingham, Mass.

[21] Appl. No.: 961,397

[22] Filed: Oct. 15, 1992

[51] Int. Cl.[5] ..... H04R 25/00

[52] U.S. Cl. ..... 381/188; 381/24; 381/182; 181/144

[58] Field of Search ..... 381/188, 24, 205, 182, 381/186, 88; 181/144, 145, 147, 199

[56] References Cited

U.S. PATENT DOCUMENTS 3,241,631 3/1966 Manieri ..... 381/182
4,054,750 10/1977 Montgomery et al. ..... 381/17

FOREIGN PATENT DOCUMENTS 0969537 6/1958 Fed. Rep. of Germany ..... 381/24
0153944 2/1982 Fed. Rep. of Germany ..... 381/24
3327994 2/1985 Fed. Rep. of Germany ..... 381/182

*Primary Examiner*—Forester W. Isen
*Assistant Examiner*—Huyen D. Le
*Attorney, Agent, or Firm*—Fish & Richardson

[57] ABSTRACT

A loudspeaker system has a number of loudspeaker driver assemblies operative over a number of octaves in the audio frequency range. Support structure supports the loudspeaker driver assemblies in fixed substantially contiguous relationship substantially along an arcuate surface with each of the driver assemblies oriented in a prescribed direction and coacting to illuminate with sound a predetermined solid angle centered at the loudspeaker system substantially uniformly over said number of octaves.

14 Claims, 27 Drawing Sheets

MULTIPLE DRIVER ELECTROACOUSTICAL TRANSDUCING

The present invention relates in general to electroacoustical transducing and more particularly concerns a novel loudspeaker system for illuminating with sound a predetermined solid angle centered at the loudspeaker system over substantially the full range of audio frequencies.

According to the invention, a loudspeaker system includes at least three loudspeaker driver assemblies with each assembly having one or more drivers and operative over a number of octaves in the audio frequency range. Support structure supports the loudspeaker driver assemblies in fixed substantially contiguous relationship substantially along an arcuate surface of length 1 and predetermined width. The axis of each of the driver assemblies has a component perpendicular to and a component parallel to the arcuate surface with each of the driver assemblies oriented in a prescribed direction and coacting to illuminate with sound a predetermined solid angle centered at the loudspeaker system substantially uniformly over the number of octaves.

Typically, the loudspeaker driver assemblies include first and second end driver assemblies, a central driver assembly and at least first and second intermediate driver assemblies between the first and second end driver assemblies, respectively, and the central driver assembly. The relative positioning of the driver assemblies establishes the predetermined solid angle over a frequency range in which the wavelength λ is between about 2l and about l. The curvature of the arcuate surface establishes the solid angle over a frequency range where λ is between about l and about ½ and the position of the intermediate driver assemblies establishes the solid angle for the frequency range where λ is between about ½ and twice the average spacing d between contiguous driver assemblies. There may be electrical circuitry, defined as shading networks, connected to some of the loudspeaker driver assemblies for establishing the solid angle for a frequency range where λ is between about 2d and about d, the shading networks typically being effective substantially only in the latter frequency range. Typically, the shading networks affect mainly the radiation from the end driver assemblies. According to an aspect of the invention, the spacing between contiguous driver assemblies is the same except for a different spacing between at least two of the driver assemblies for establishing the solid angle for the frequency region for λ between about d and about d/2 through spatial dithering. Spatial dithering is departure from regular spacing between adjacent driver assemblies. The orientation of each of the driver assemblies establishes the solid angle for the frequency range where λ is considerably less than the span S across each driver assembly, typically the diameter of a driver for a single-drive assembly.

According to another aspect of the invention, the support structure comprises a ported enclosure. The ported enclosure is typically arcuate and has a rear concave surface normally facing a room bounding surface and formed with at least one port opening so that when the enclosure contacts a room bounding surface, each port opening remains uncovered.

Other features and advantages will become apparent from the following detailed description when read in connection with the accompanying drawing in which:

DESCRIPTION OF THE PREFERRED EMBODIMENTS

Figure 1:
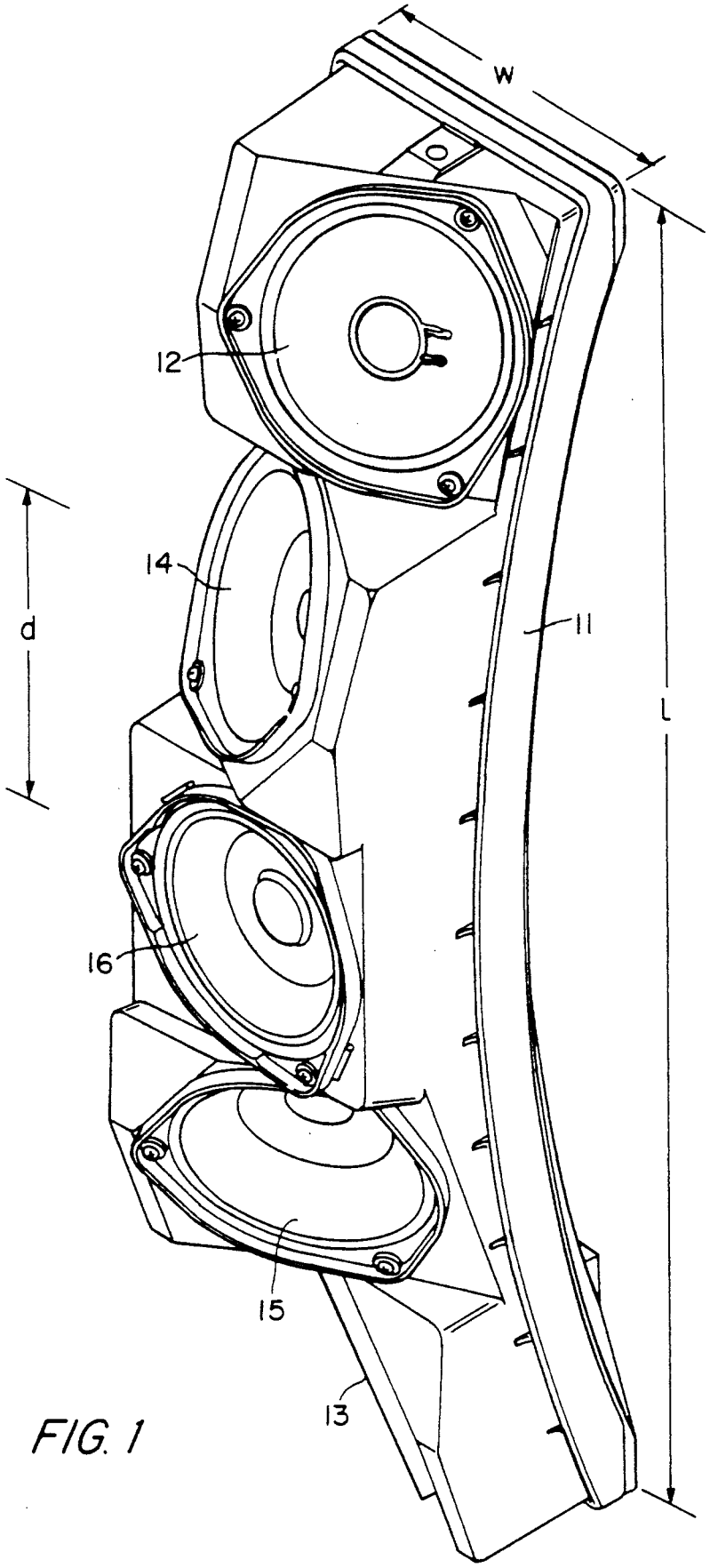
FIG. 1 is an isometric view of an exemplary embodiment of the invention.
Figure 2:
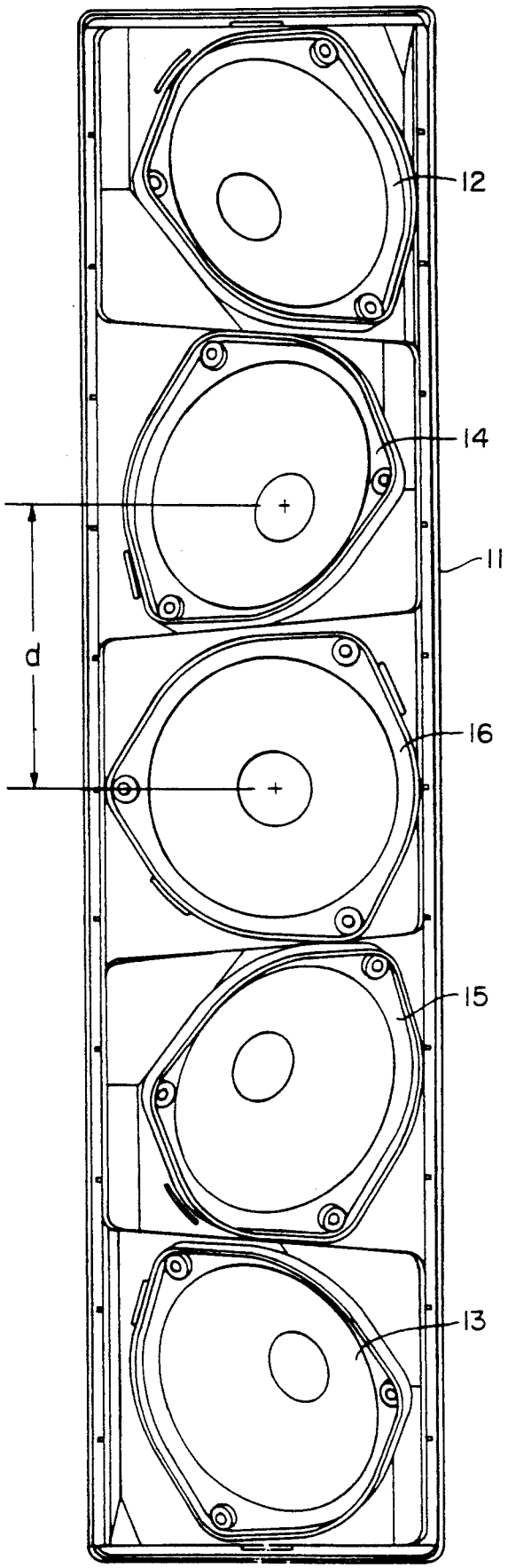
FIGS. 2, 3, 4 and 5 are front, side, top and rear views, respectively, of the exemplary embodiment.
Figure 3:
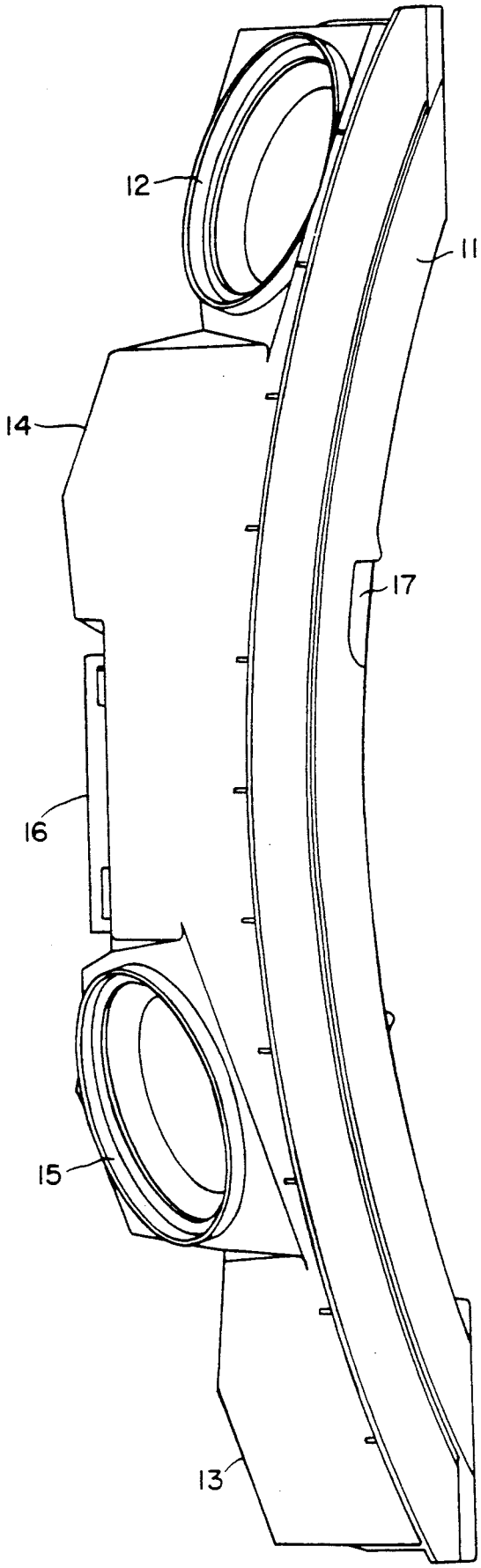
Figure 4:
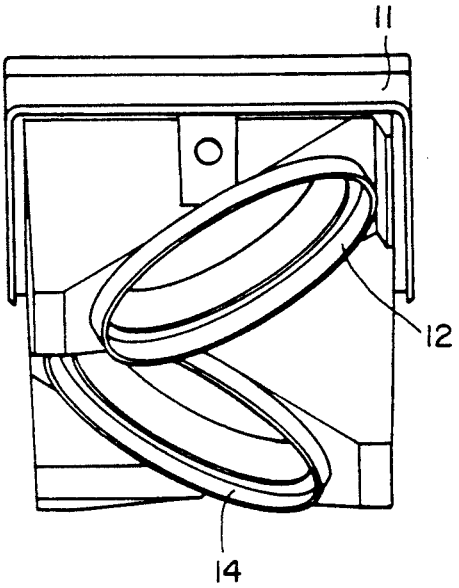

With reference now to the drawing and more particularly FIG. 1 thereof, there is shown an isometric view of an exemplary embodiment of the invention with each loudspeaker driver assembly consisting of a single driver. A support structure 11, typically made of molded plastic, such as high-impact poly-styrene, supports end loudspeaker drivers 12 and 13, intermediate loudspeaker drivers 14 and 15 and center loudspeaker driver 16 substantially on an arcuate surface of length 1 and width w corresponding substantially to the diameter of each driver with each driver oriented in a different direction. The average separation between centers of adjacent drivers is d.

The same reference numerals identify corresponding elements throughout the drawing. Referring to FIGS. 2, 3, 4 and 5, there are shown front, side, top and rear views of the exemplary embodiment.

Figure 6:
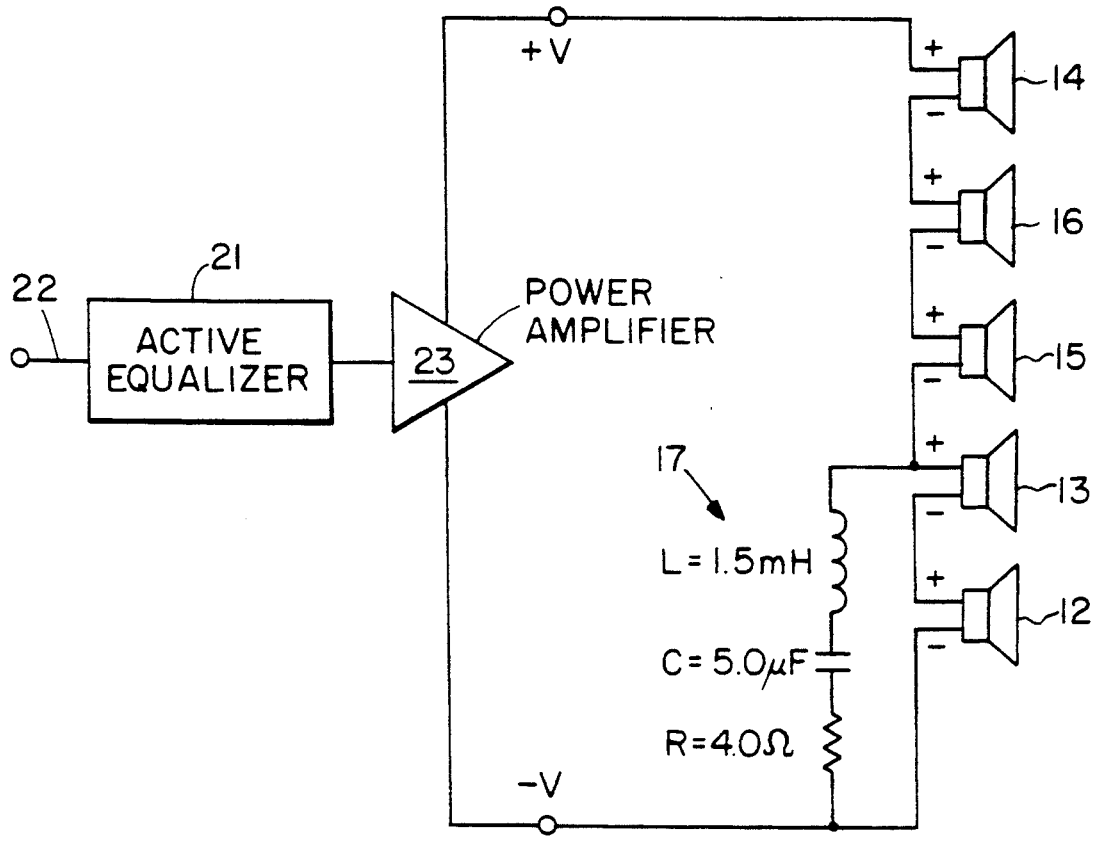
FIG. 6 is a block diagram illustrating the logical arrangement of a system according to the invention.
Figure 7A:
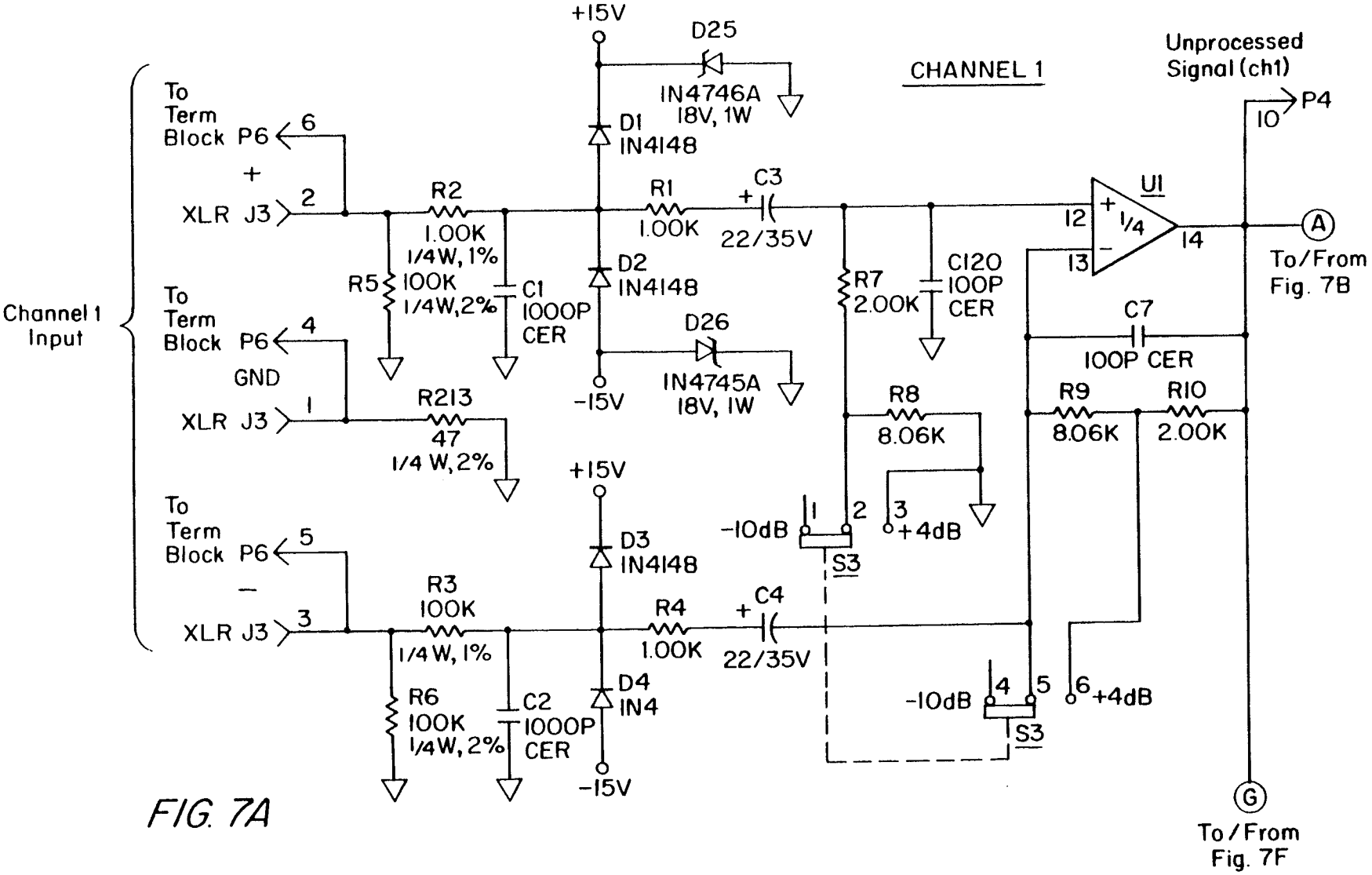
FIGS. 7A–7N and 7P–7X are schematic circuit diagrams of a controller in an exemplary embodiment of the invention showing specific parameter values.
Figure 7B:
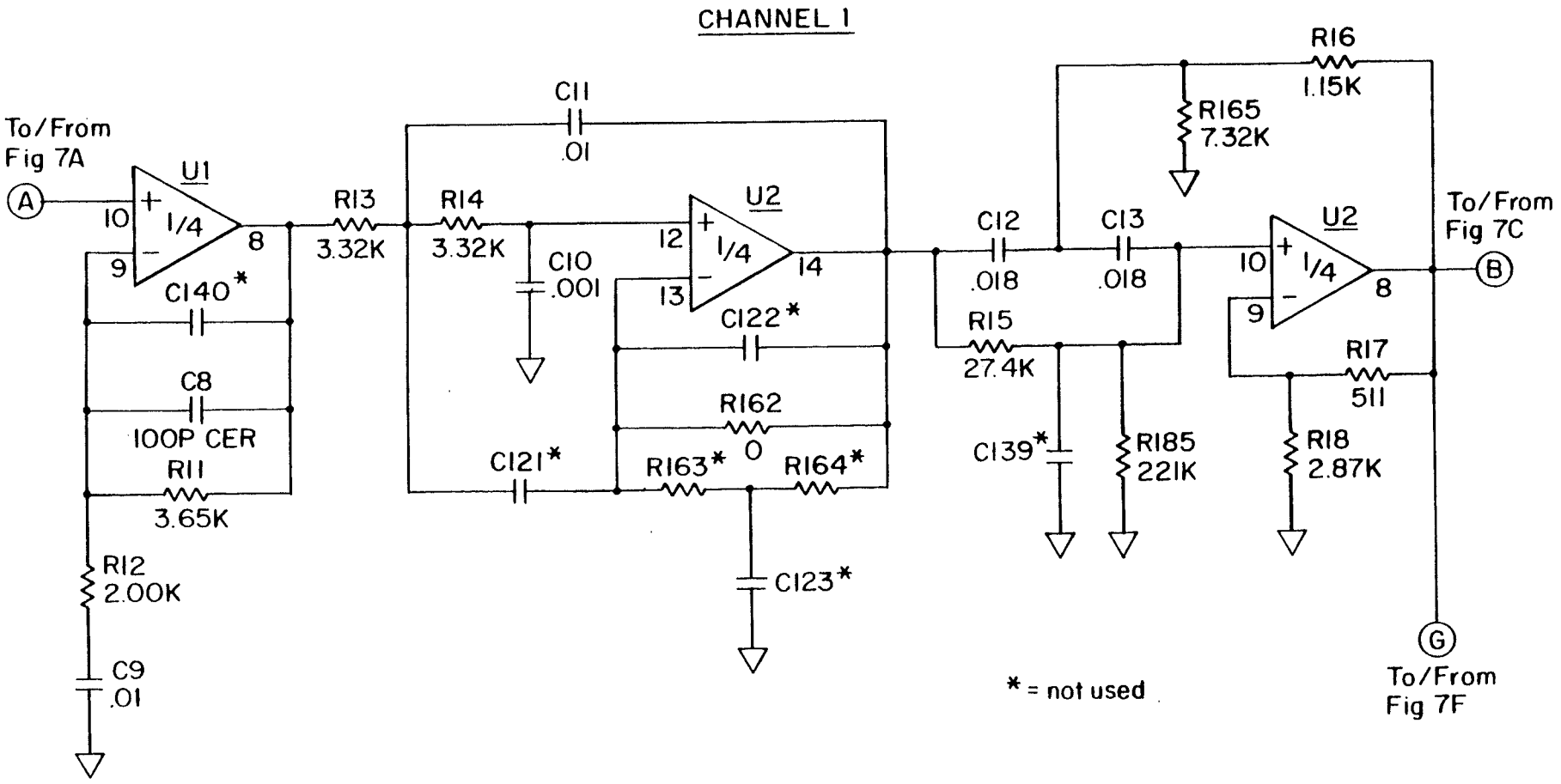
Figure 7C:
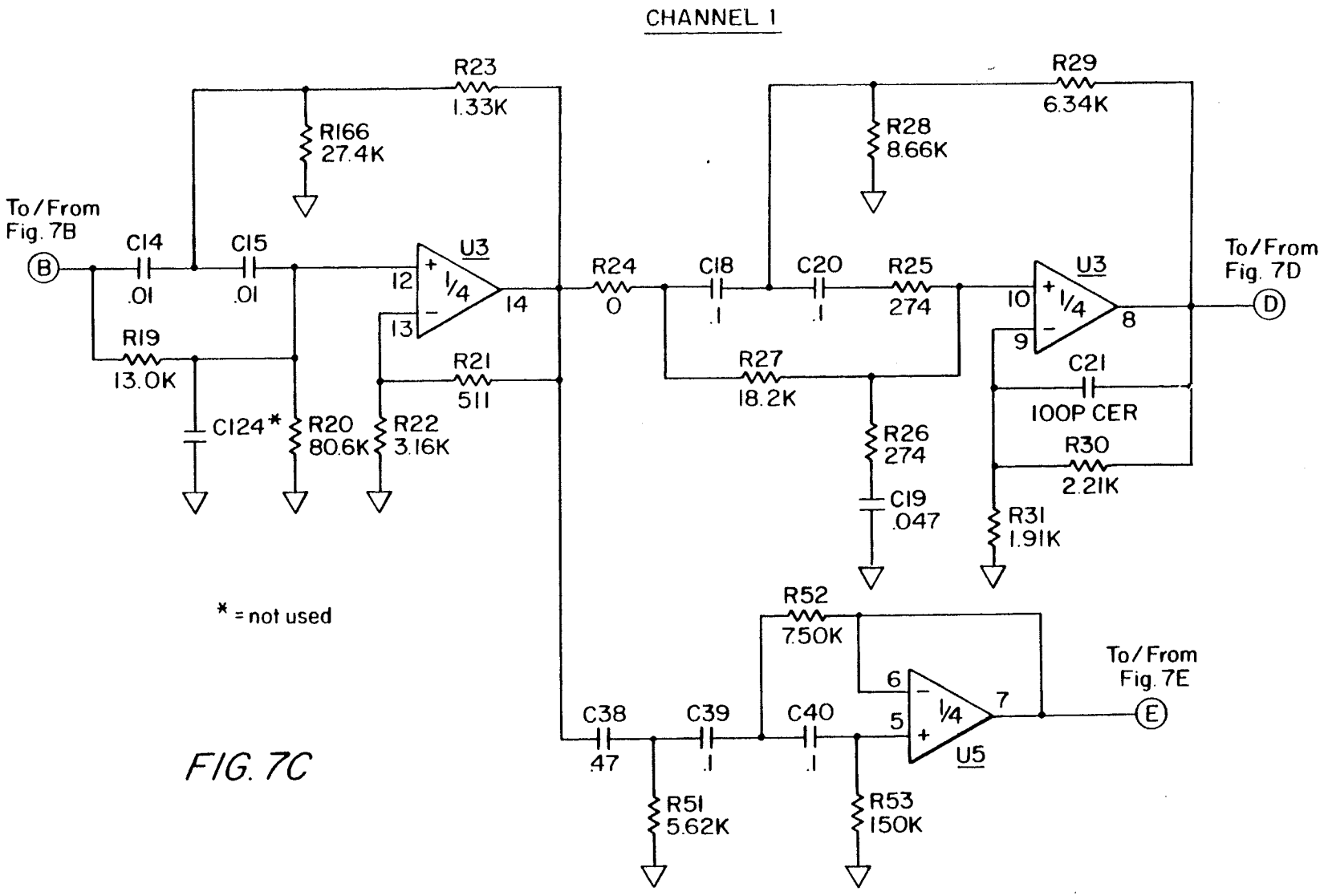
Figure 7D:
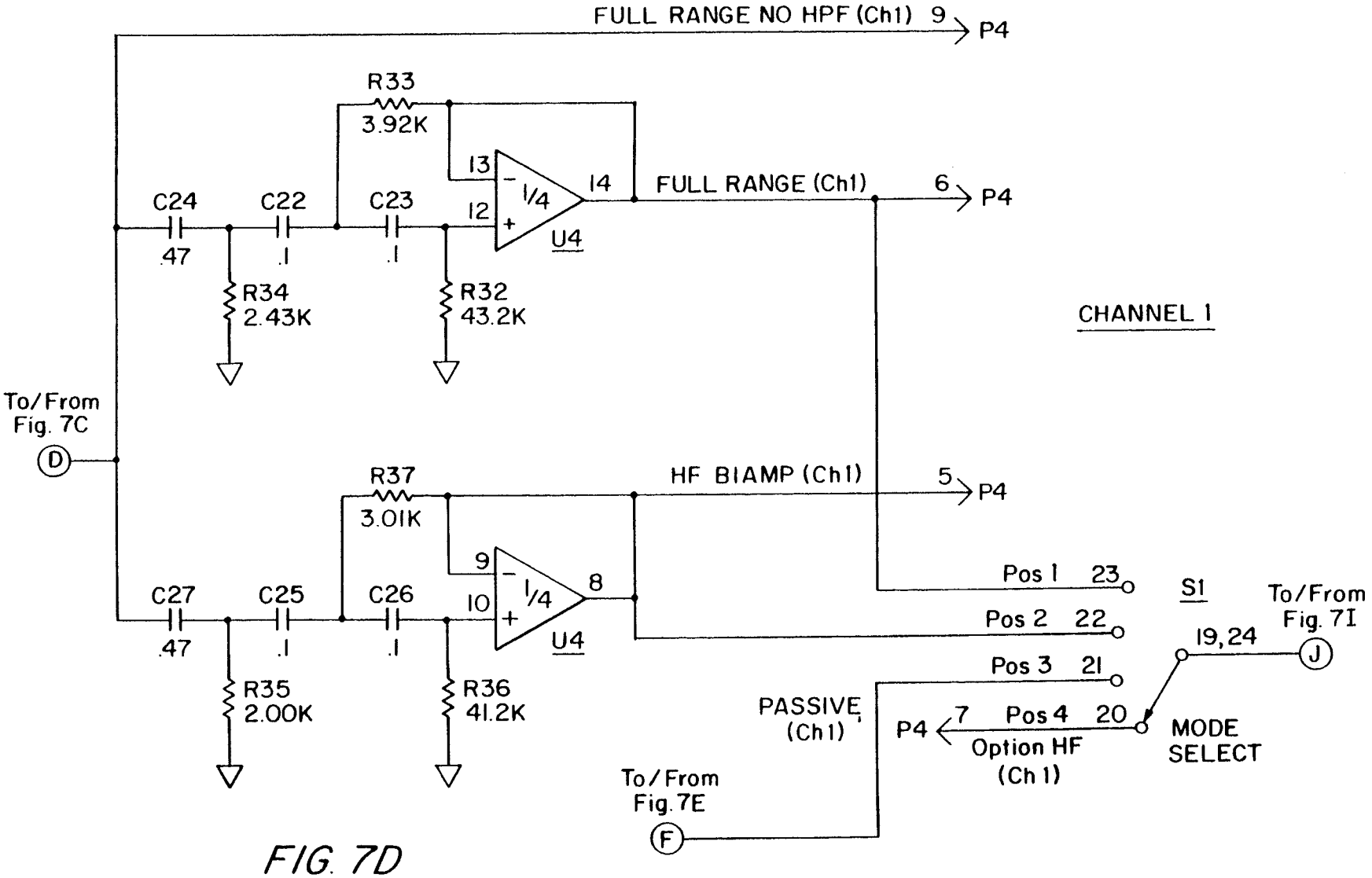
Figure 7E:
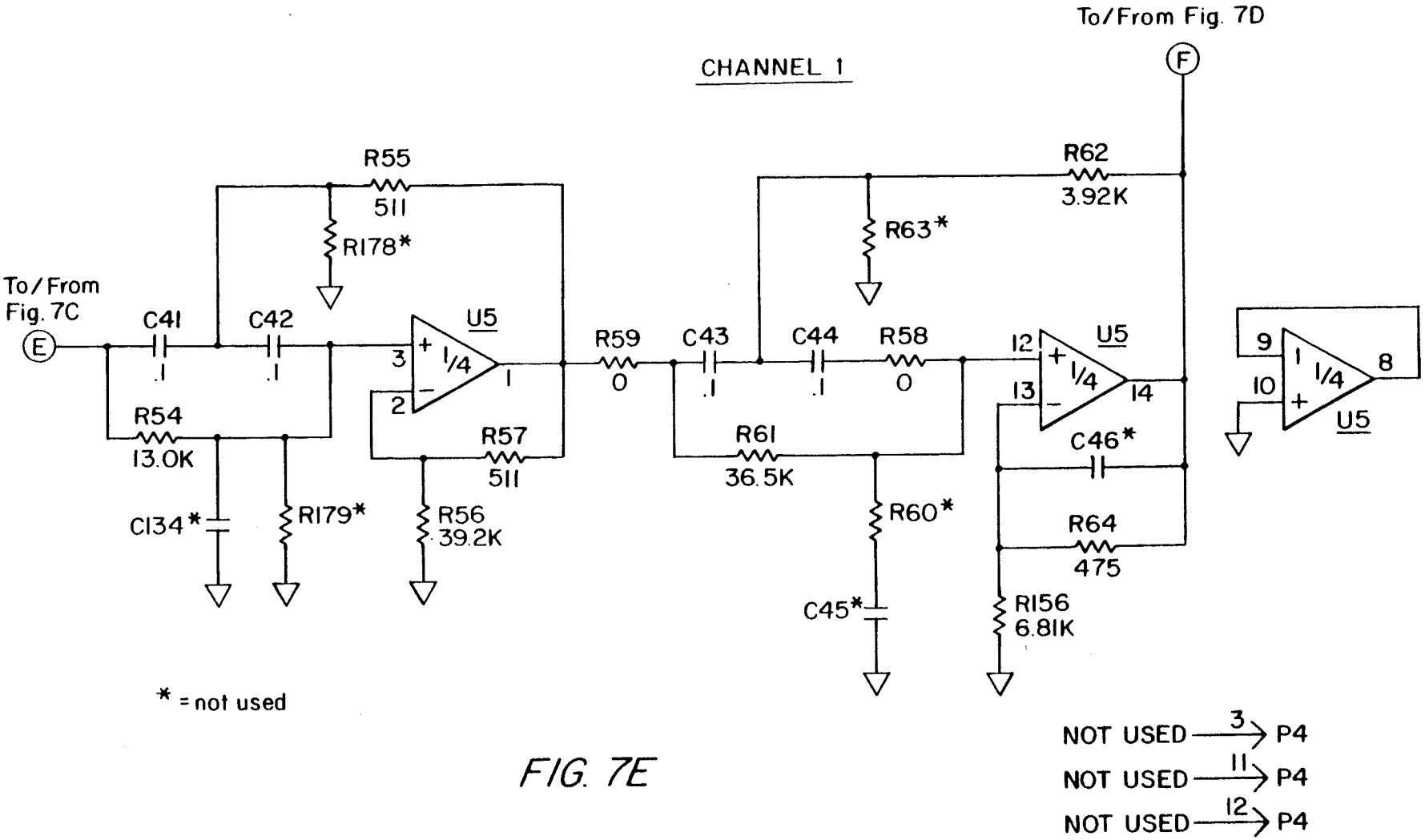
Figure 7F:
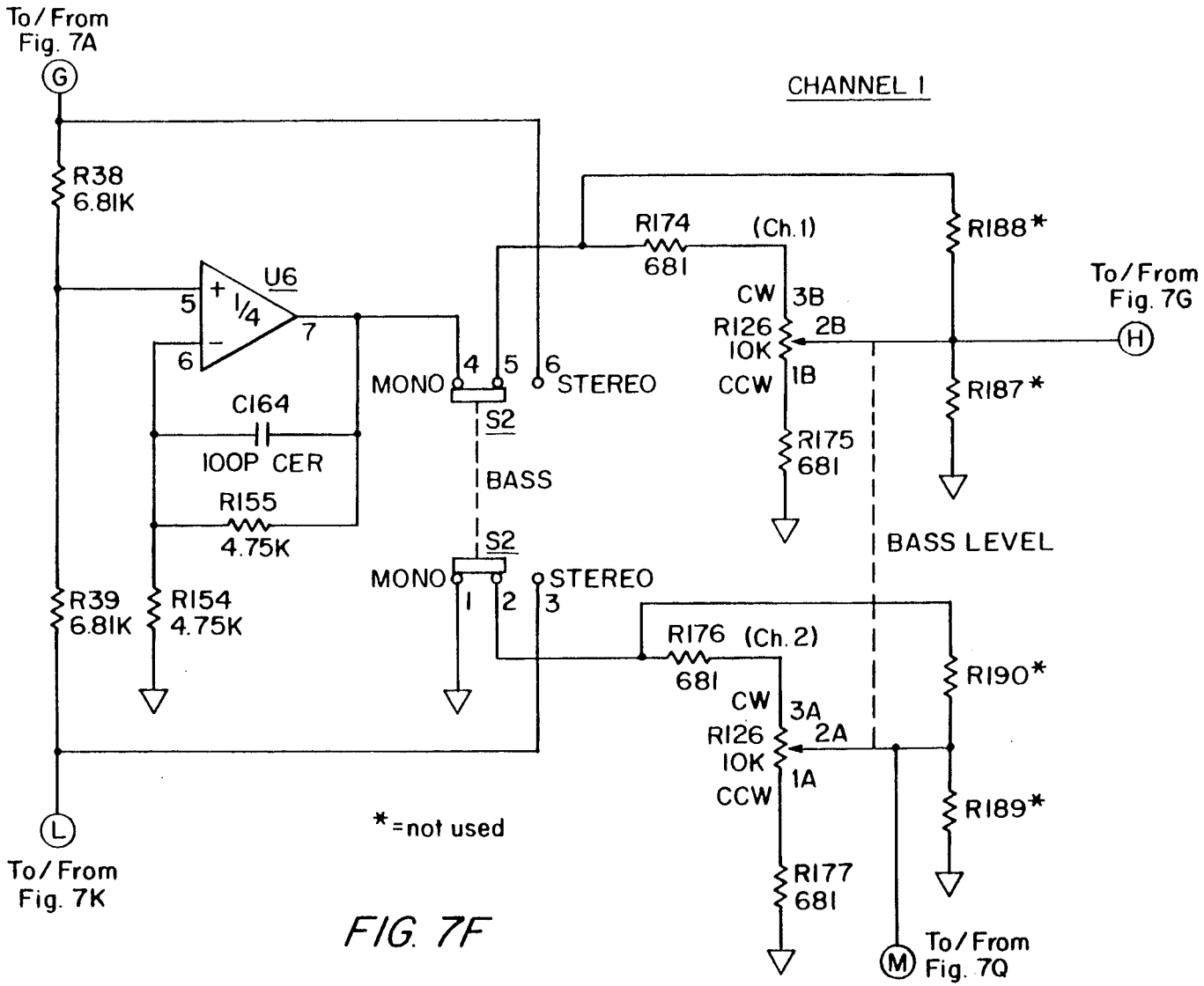
Figure 7G:
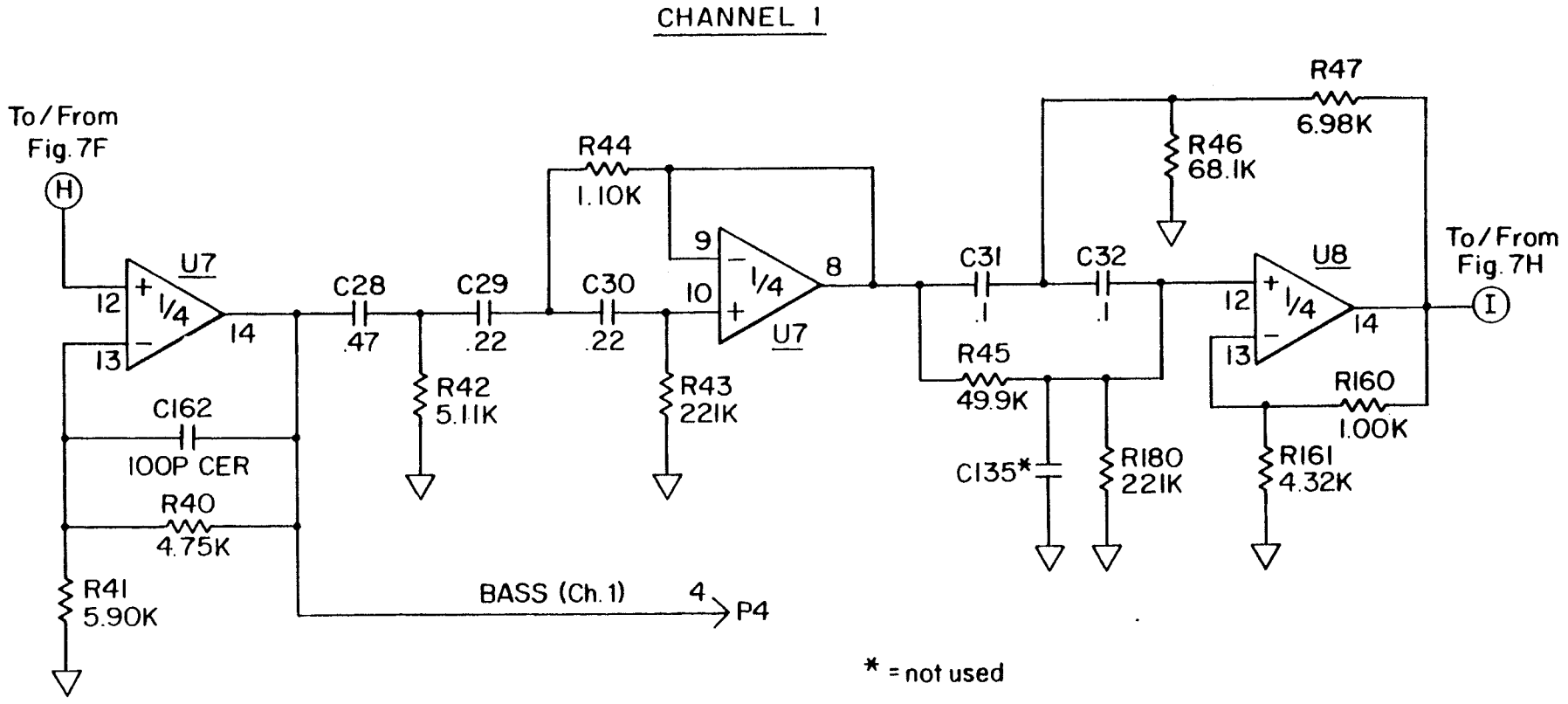
Figure 7H:
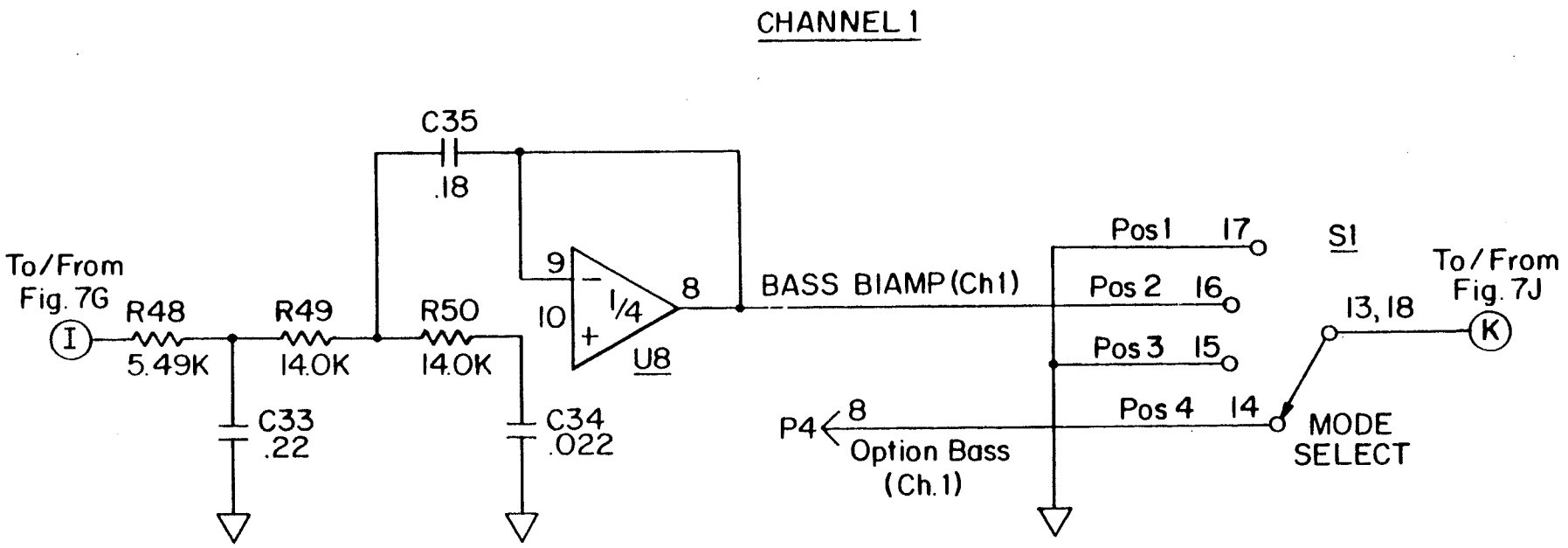
Figure 7I:
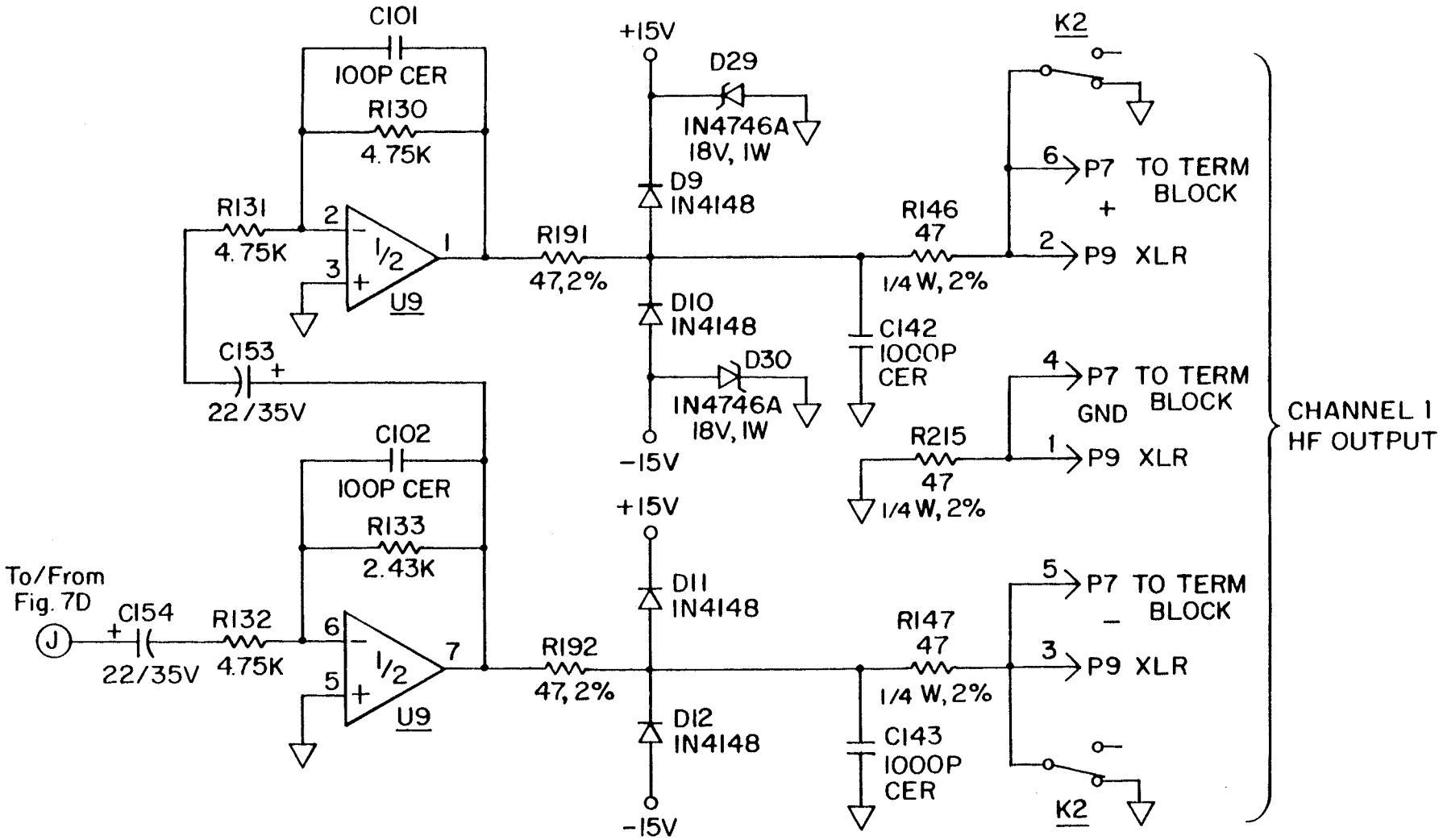
Figure 7J:
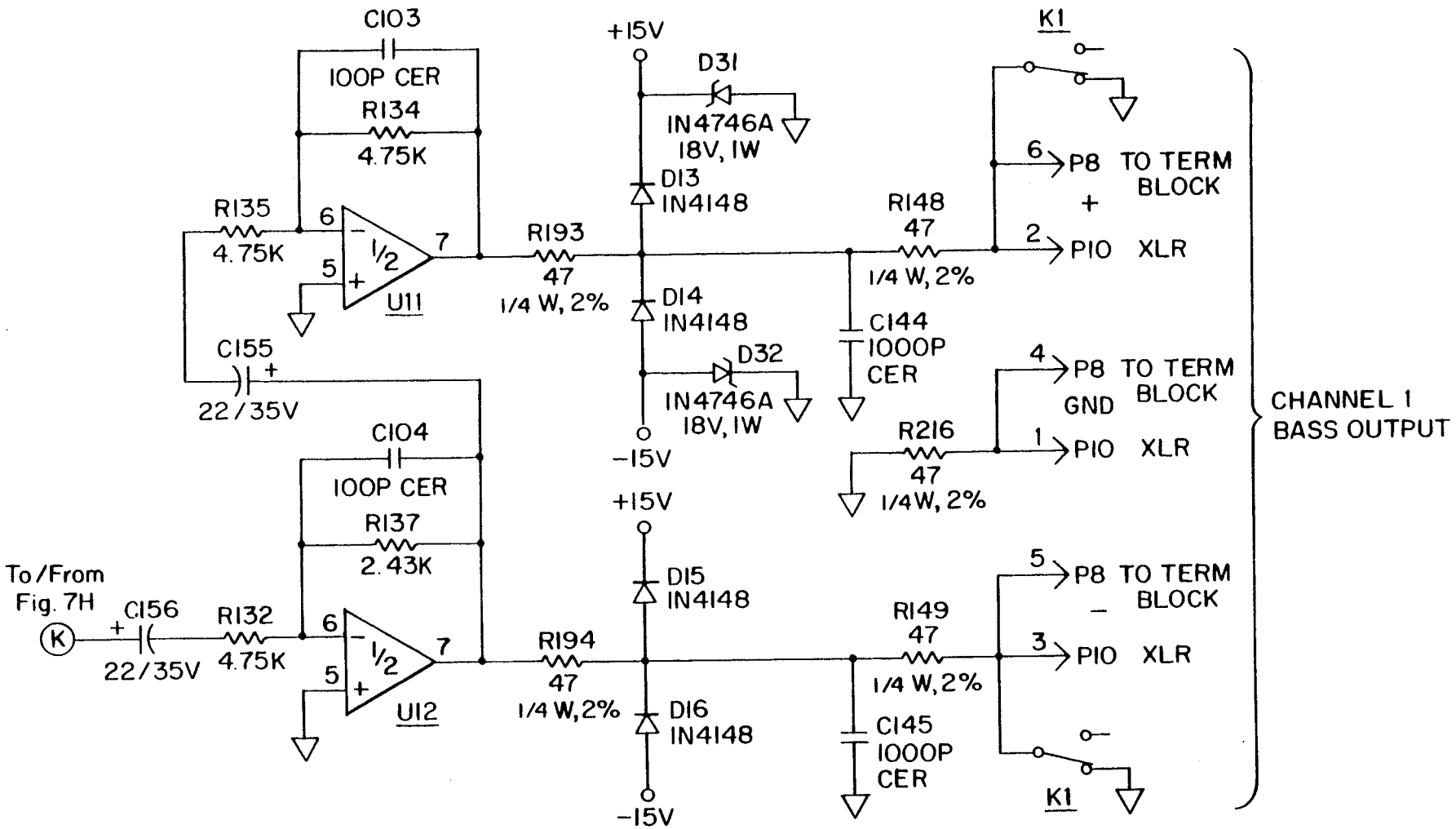
Figure 7K:
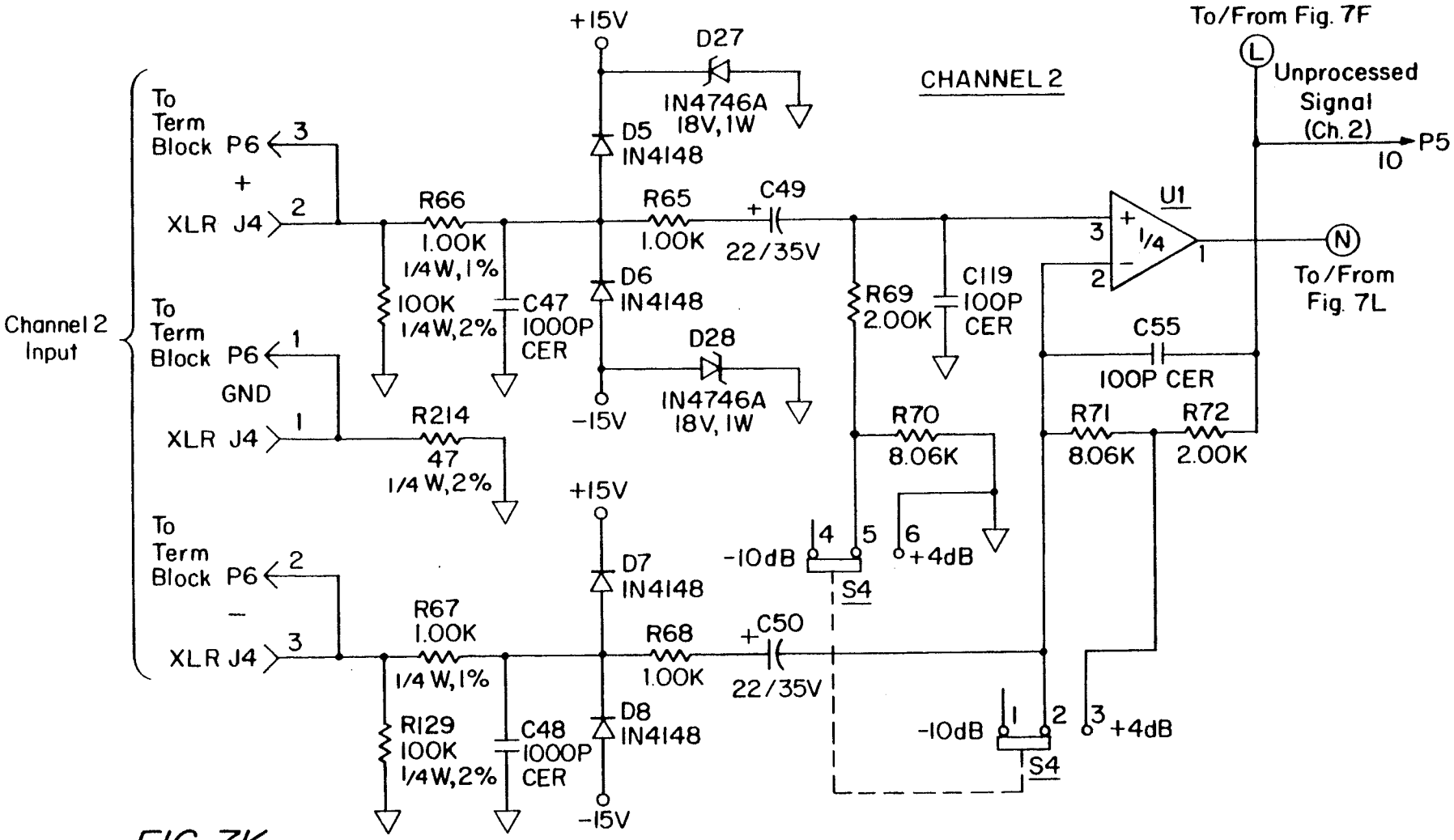
Figure 7L:
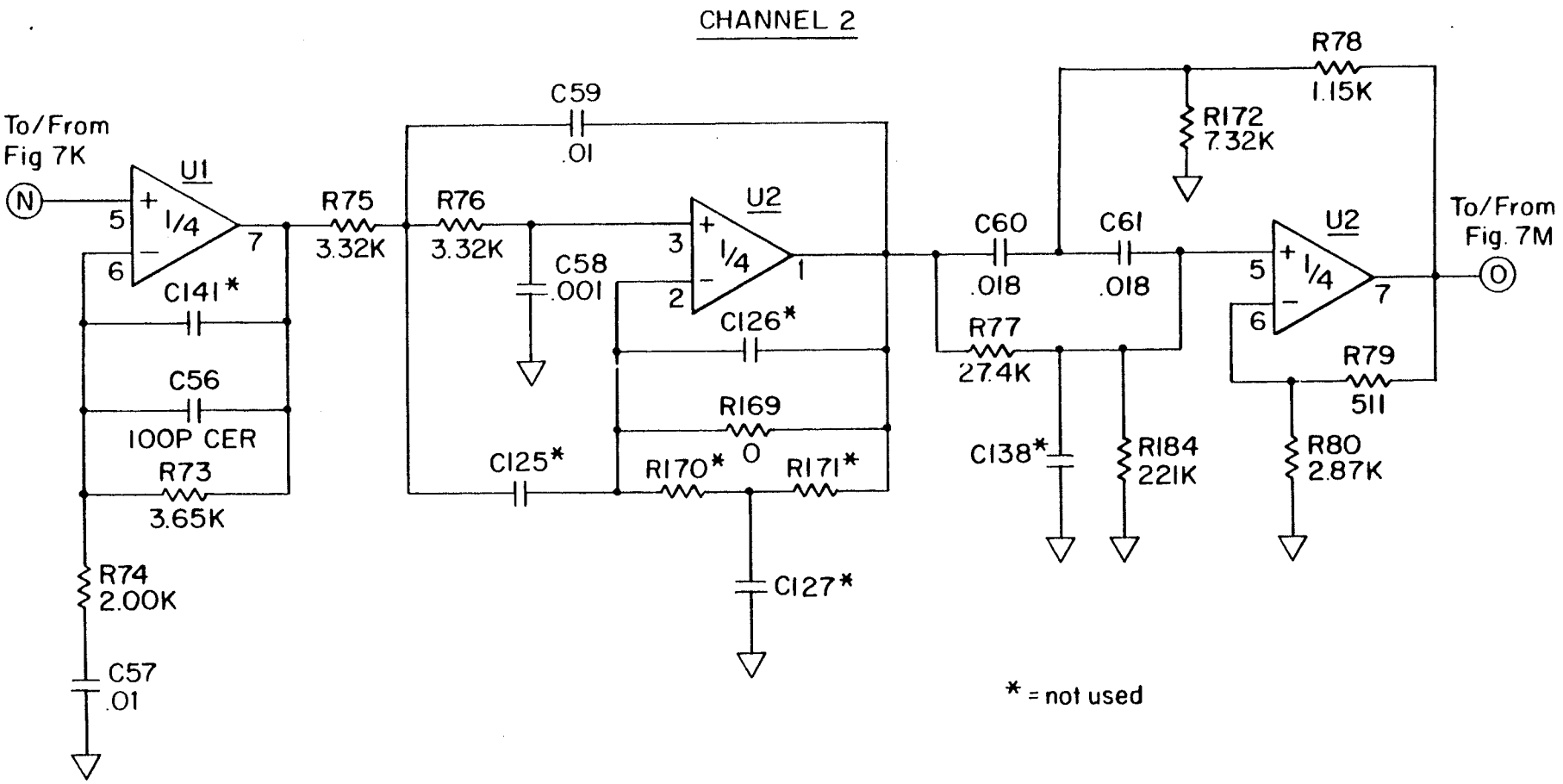
Figure 7M:
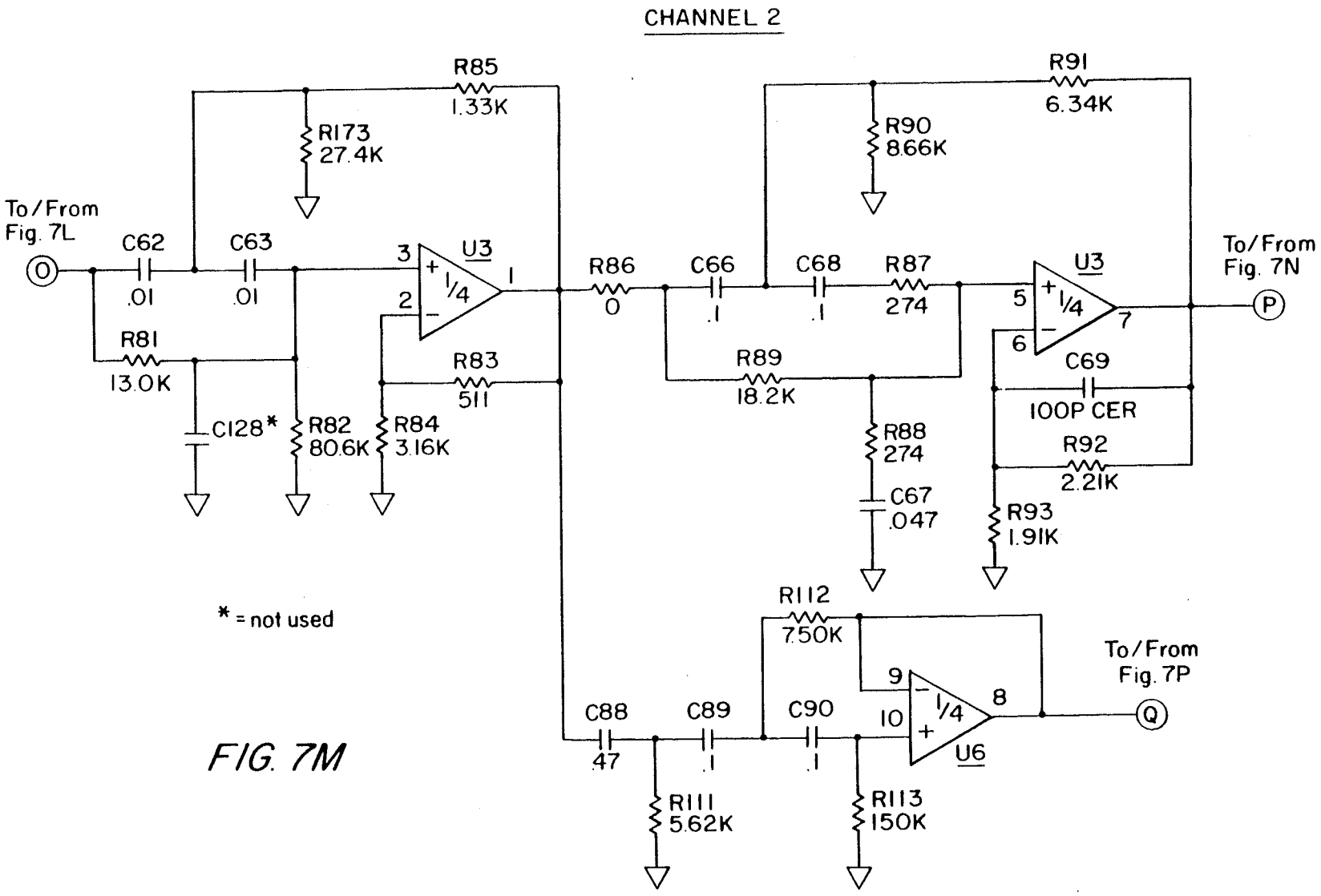
Figure 7N:
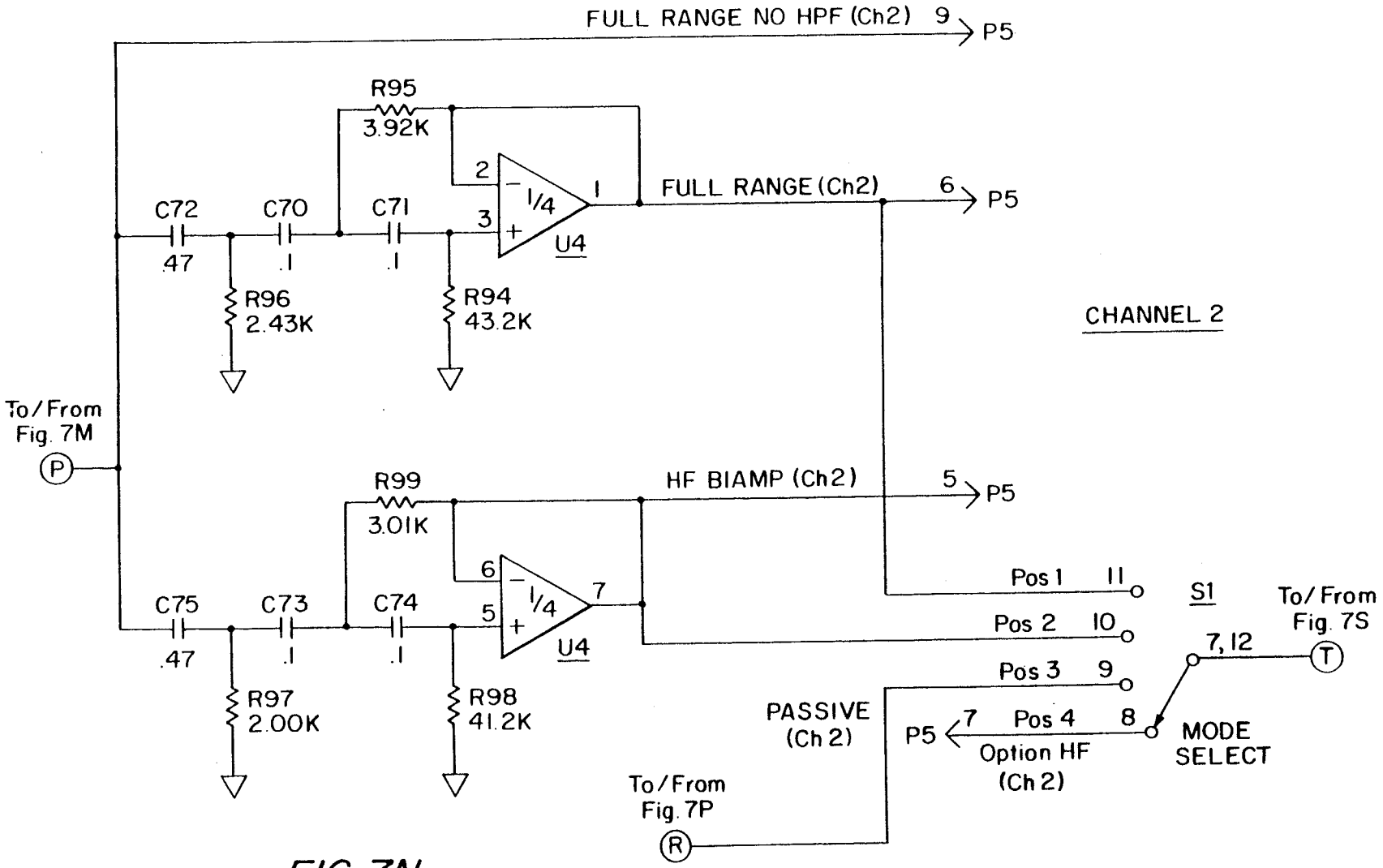
Figure 7P:
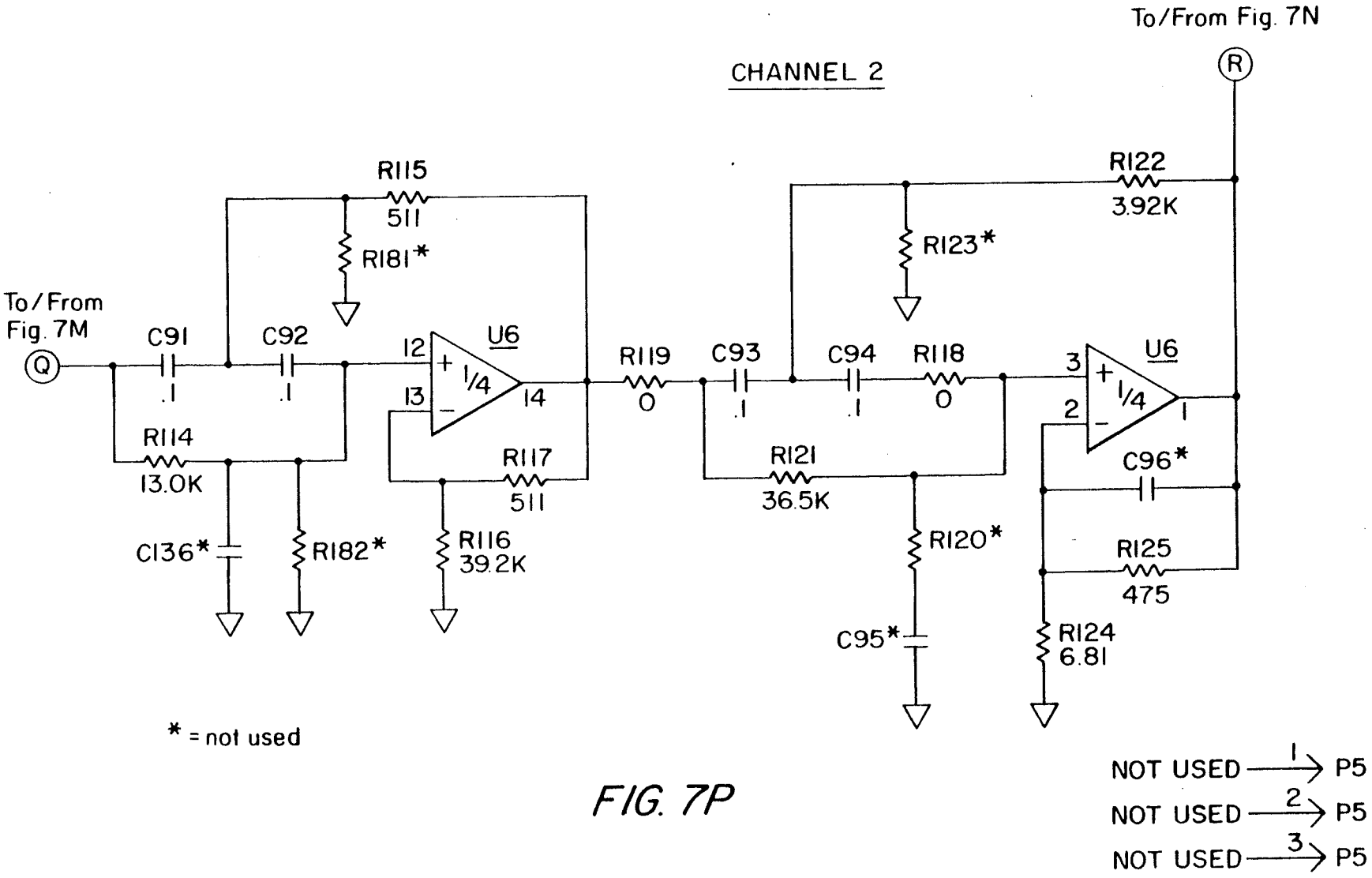
Figure 7Q:
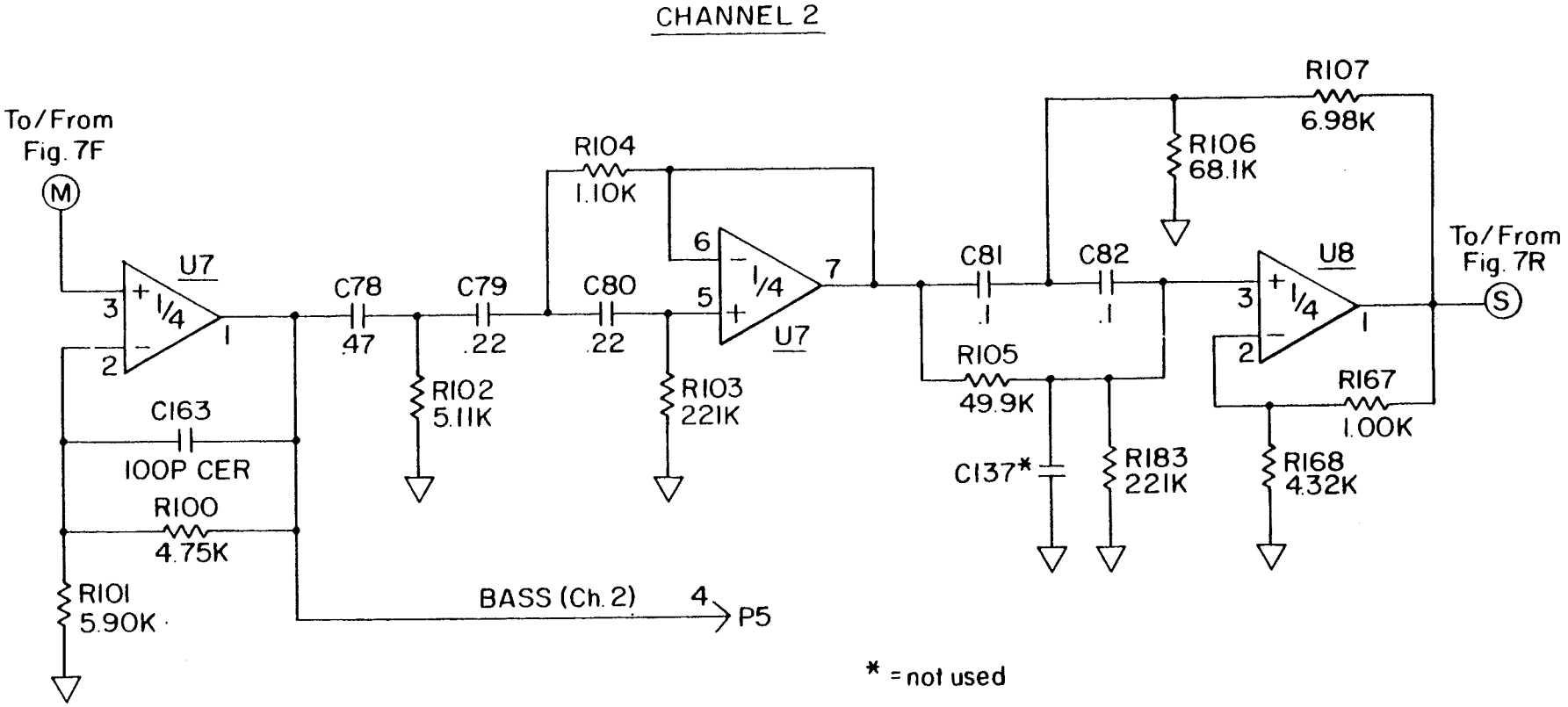
Figure 7R:
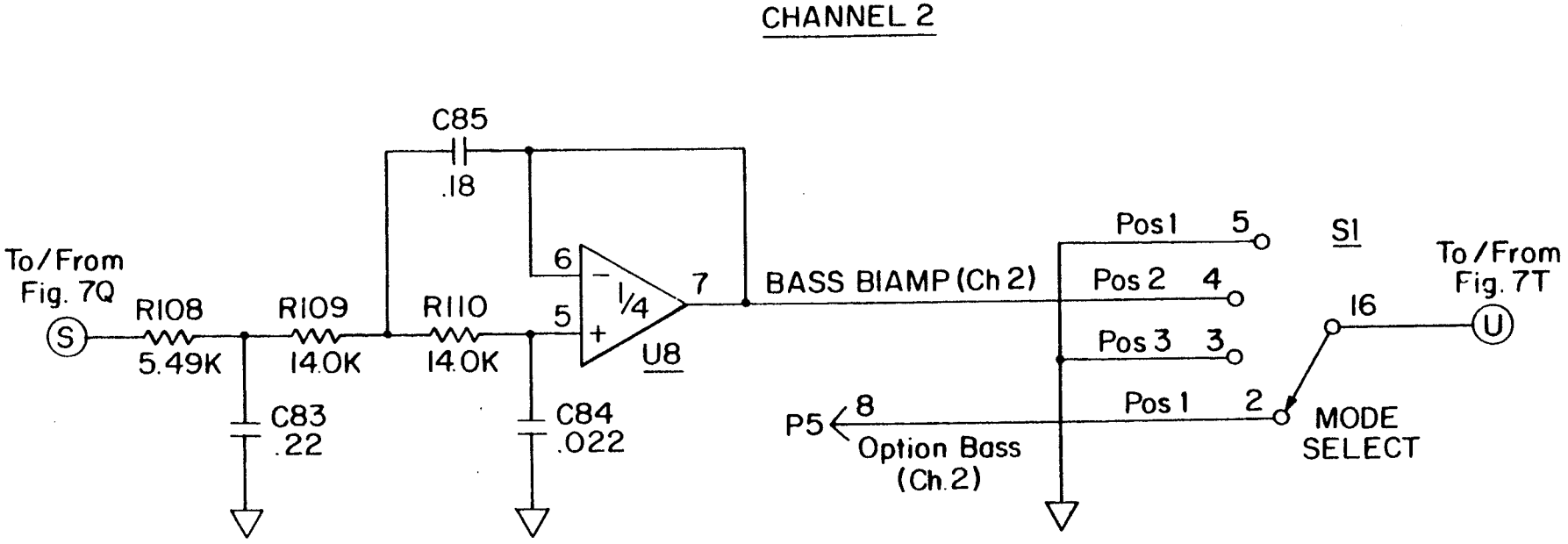
Figure 7S:
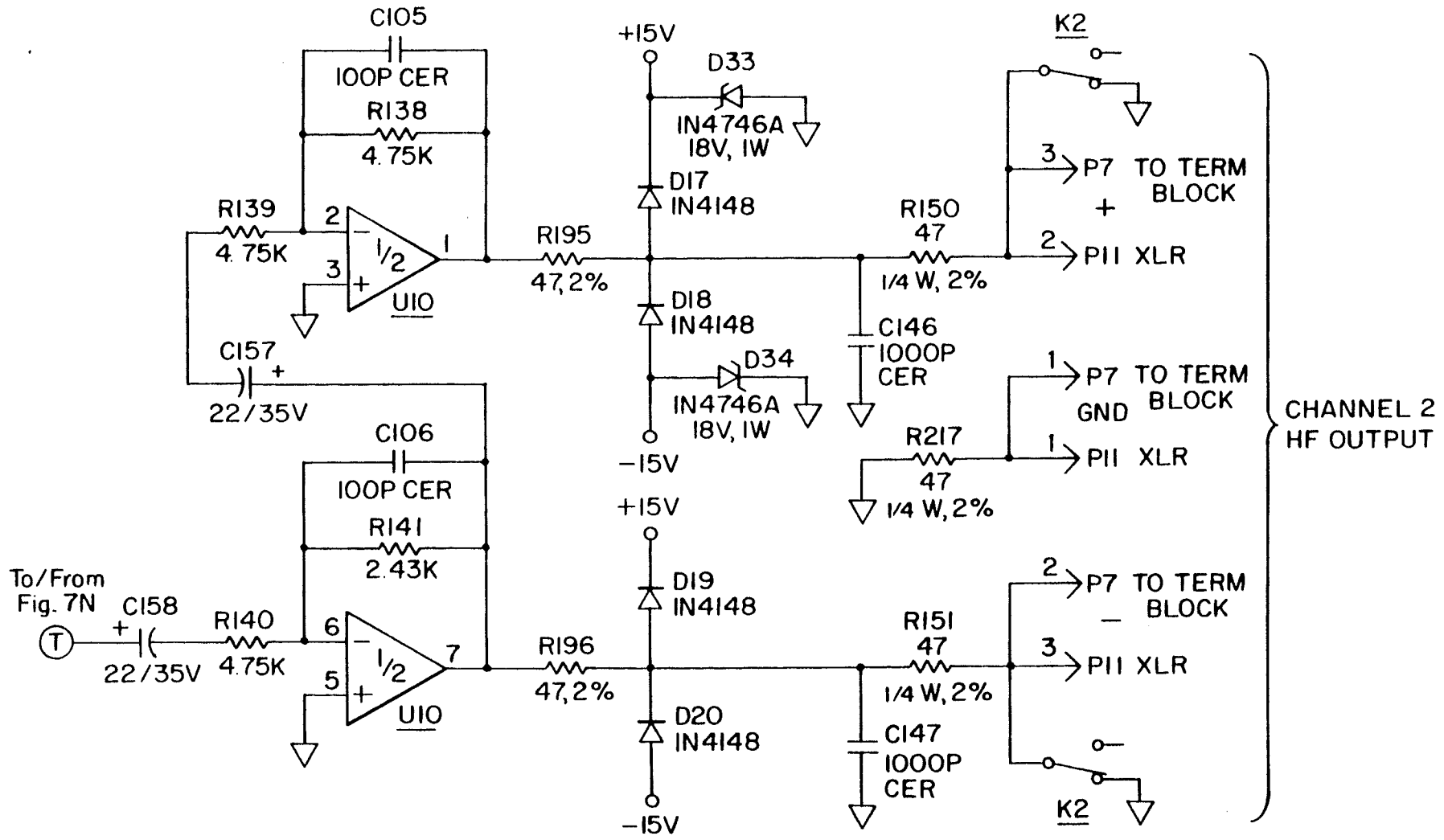
Figure 7T:
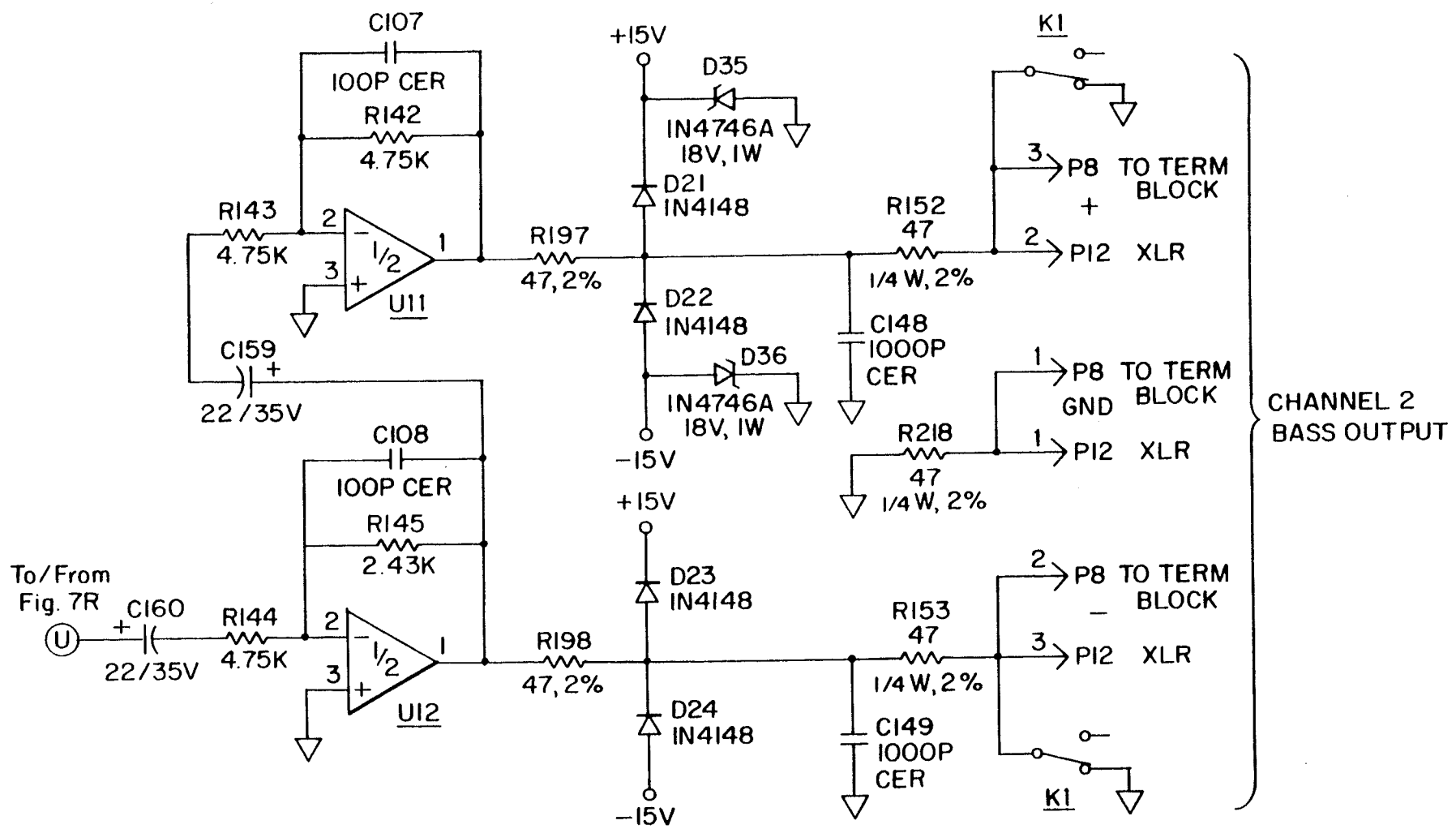
Figure 7U:
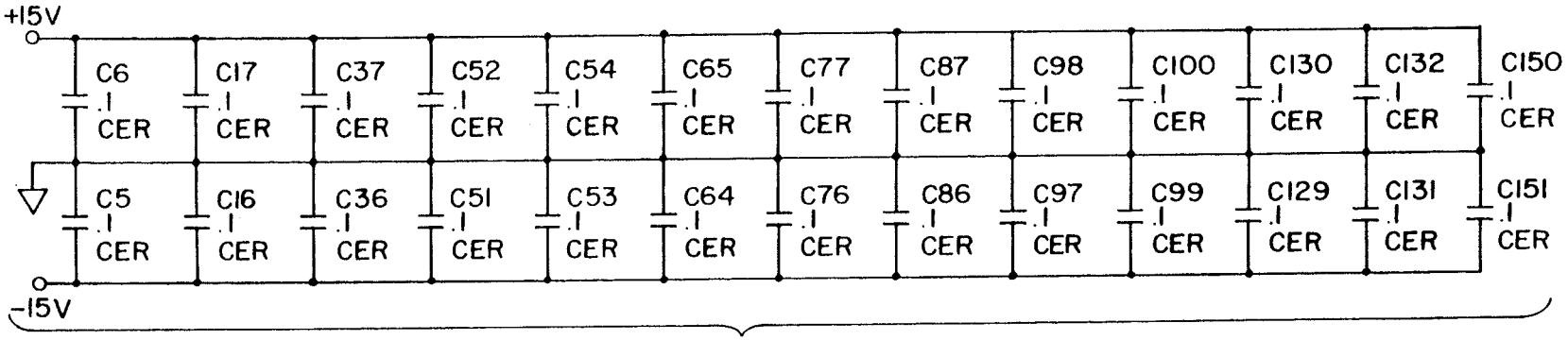
Figure 7V:
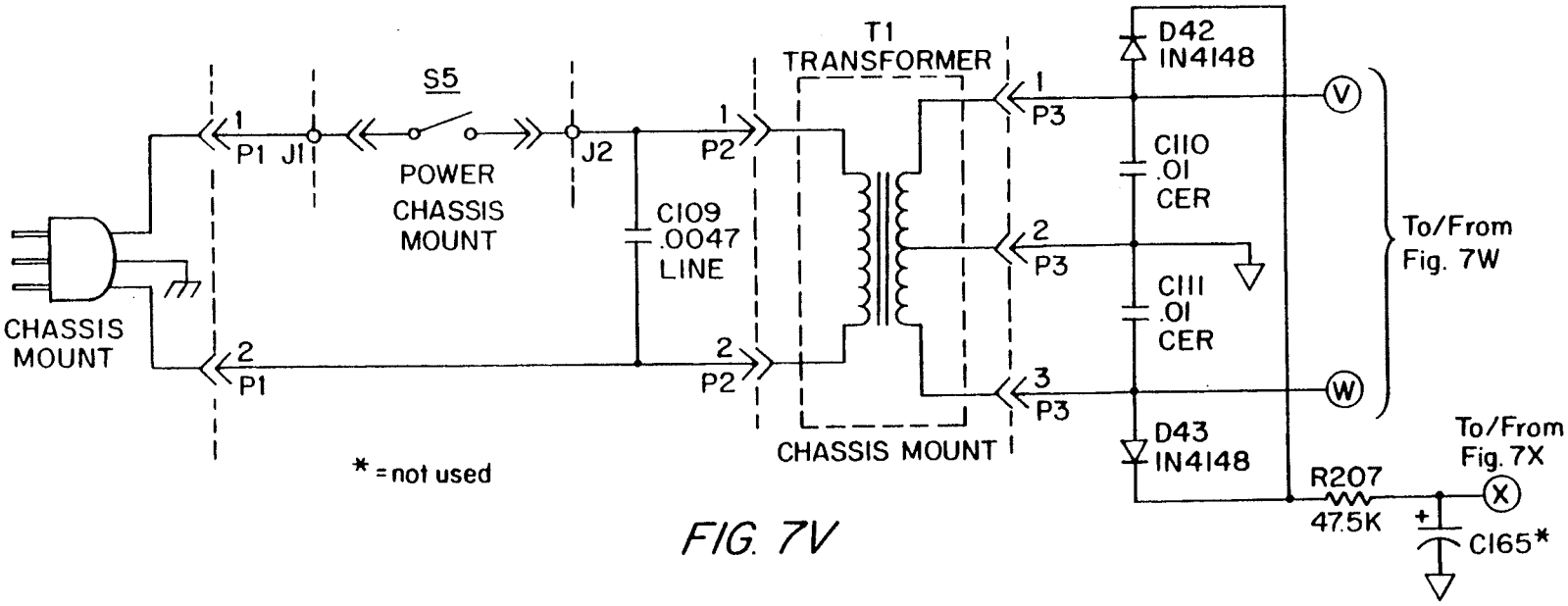
Figure 7W:
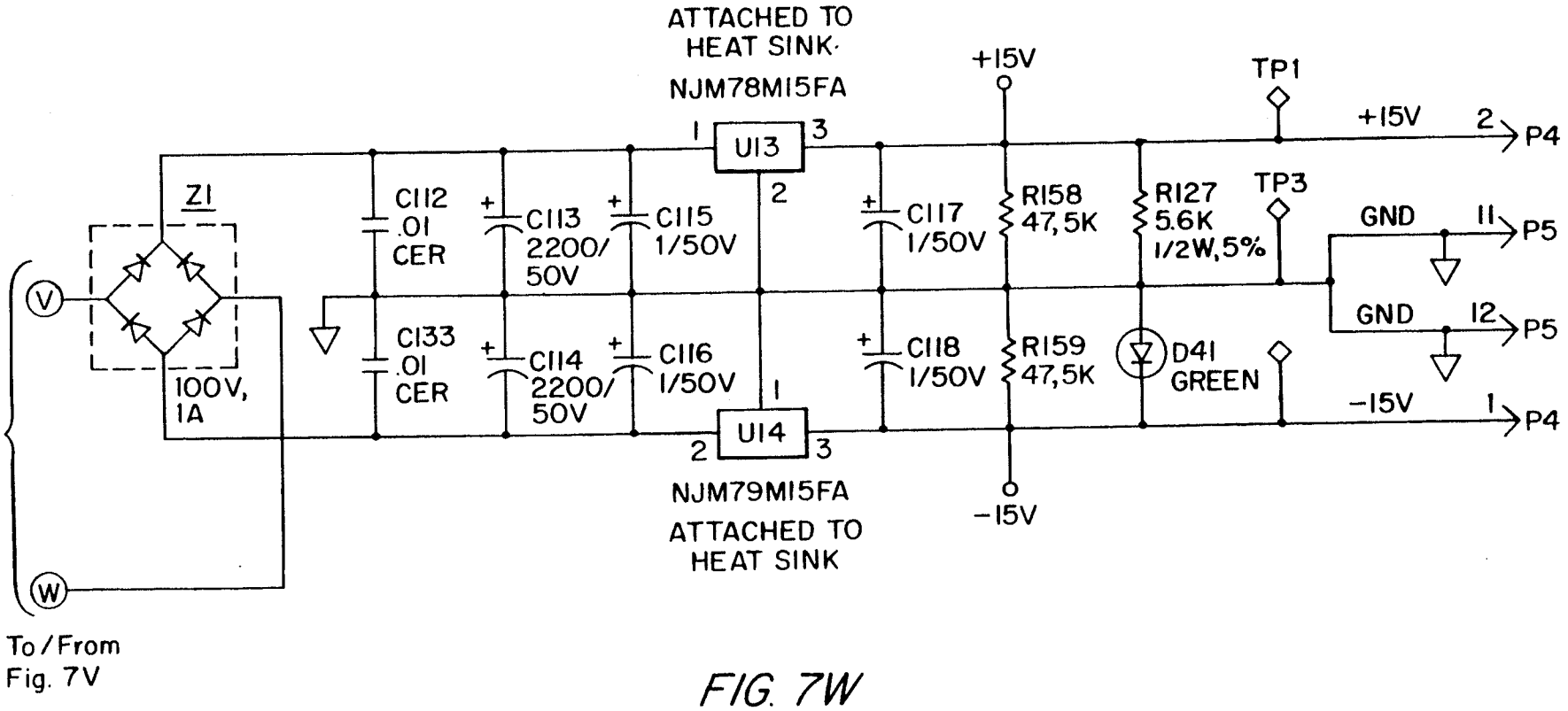
Figure 7X:
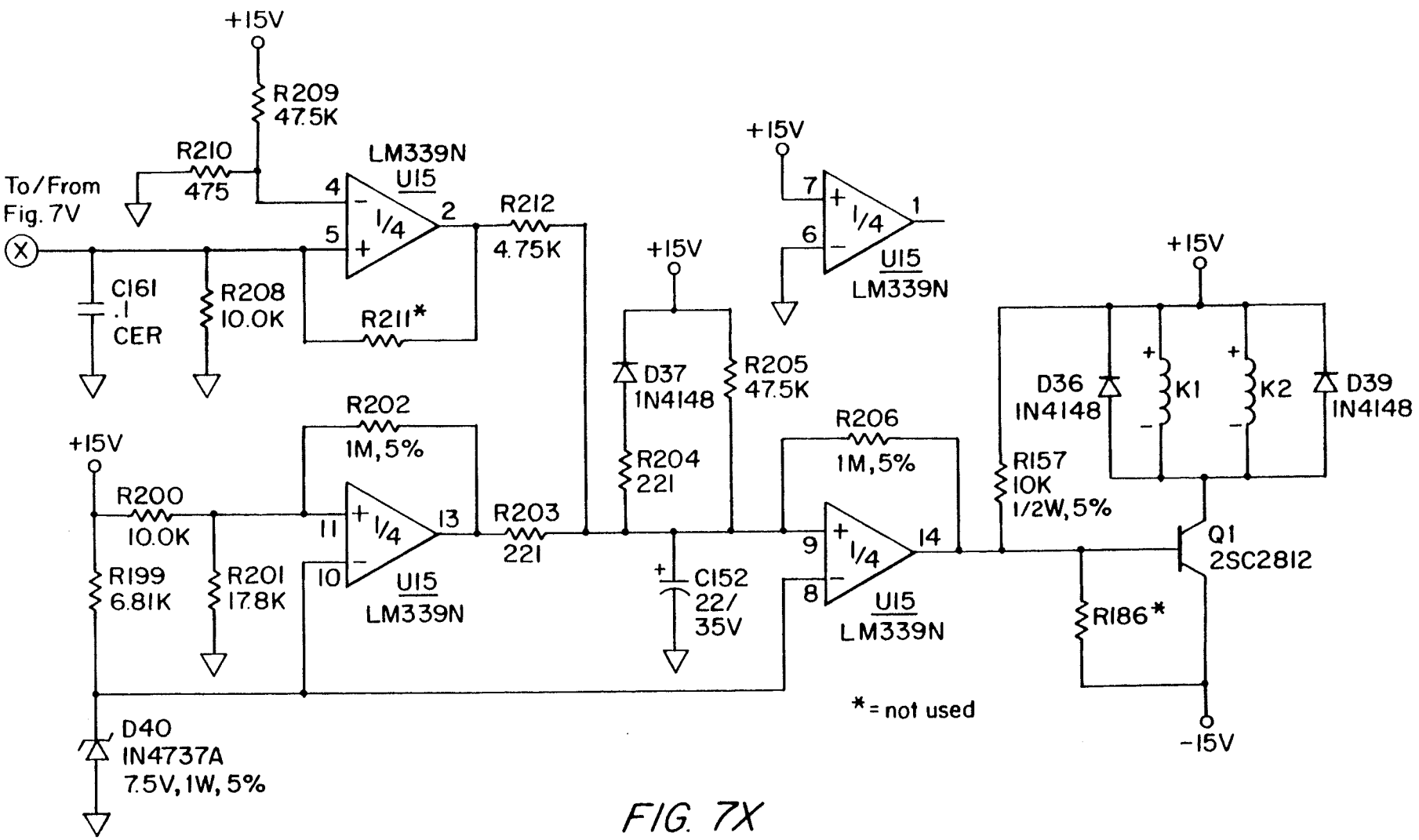

Referring to FIG. 6, there is shown a block diagram of the exemplary embodiment illustrating the logical arrangement of using active equalization and shading networks. An active equalizer 21 receives an input audio signal to be reproduced on input 22 and energizes power amplifier 23. Power amplifier 23 energizes drivers 12–16 in phase and in series with end drivers 12 and 13 shunted by shading network 17, operative to provide phase shift or amplitude attenuation only within a predetermined frequency range as explained below.

Having described the physical arrangement of a loudspeaker system according to the invention, its mode of operation will be described. The invention embodies a number of design techniques to provide control of the directional characteristic from lower frequencies, where the wavelength λ is about twice the whole array, up to higher frequencies where the wavelength is much less than the span of each driver. Combining the different techniques according to the invention builds a bridge from the lower to the higher frequencies to control the directional characteristics to be substantially the same across the entire frequency region. Each technique is used to control directionality substantially within only one frequency region and when applied in that region, it almost does not affect other regions.

The frequency range referred to the wavelength λ is specified relative to array dimension 1, typically the array length and average spacing between contiguous drivers d. The regions of control are listed in order of increasing frequency.

The lowest frequency region of control is where λ is between about 2l and about l. In the exemplary embodiment, l is the length of the array having a width w corresponding substantially to the diameter of each driver. However, it is within the principles of the invention to expand the width dimension and/or the length dimension, by increasing the number of drivers in either or both directions. According to the invention, initially position the drivers according to the rule that the more directional the array is to be in a selected plane through the array, provide greater extent of the array as projected in that plane. For example, the array shown in the drawing is more directional in the vertical plane than in the horizontal plane. Furthermore, the drivers are preferably packed together as closely as practical. Reducing spacing between drivers increases the frequency at which the interdriver interference effects become a problem.

The next frequency region of control is where λ is greater than about ½ yet smaller than about 1. In this frequency region arcing controls the directional characteristics. Arcing may be achieved by bowing the outer and intermediate drivers backwards, while systematically positioning them on the surface of a substantially arcuate surface, typically a portion of a sphere or an ellipsoid. In this frequency region, the outer and center drivers 12, 13 and 16 are mostly responsible for establishing the directional characteristics because they substantially determine the overall shape of the array. An arcuate surface of small radius of curvature produces a wide radiation pattern.

The next frequency region of control is where λ is between about ½ and about 2d. In this region coarse positioning of the intermediate drivers, such as 14 and 15, controls the directional characteristics. This coarse positioning occurs while maintaining the overall shape of the array as determined in the arcing frequency region.

Moving up in frequency, the next frequency region of control is where λ is between about 2d and about d. In this region, an electrical shading network, or networks connected to some drivers effectively control directional characteristics even in the presence of strong interdriver interference. Typically, shading networks, such as 17, furnish phase and/or magnitude shading to alter phase and/or magnitude of energy having spectral components only in this frequency range energizing outer drivers 12 and 13. A feature of the invention is that the shading networks are substantially only effective in this frequency range so that all drivers are substantially fully operational outside this band as if the shading networks were absent. Also the amounts of attenuation introduced are relatively small, typically about 3 dB. By attenuating the outer drivers, interference between drivers is decreased within the predetermined solid angle in this frequency range only.

In the next frequency region of control λ is between about d and about d/2. In this region, spatial dithering controls the directional characteristics. Systematically positioning drivers forwards, backwards or sidewards by small amounts to interrupt the regular spacing of the array accomplishes spatial dithering. The position departures from regularity are relatively minor because the wavelength at these frequencies is comparable to driver size. It has been discovered that any one driver may be involved in providing spatial dithering. The result of spatial dithering is to weaken dominant side lobes. These undesirable lobes are strongest when interdriver spacing is regular.

The highest frequency region of control is the region where λ is much less than the diameter of the drivers. At these frequencies the drivers have each become more directional. By pointing the individual drivers in respective different directions, they may be aimed to provide the desired radiation pattern in this frequency range. The basic rule is that if energy is desired in a given direction, in this frequency range some driver must point in that direction.

Another feature of the invention resides in port structure that avoids unequal acoustic impedances of the resonant enclosure as seen by the various drivers while ensuring that port openings, such as 18 and 18' (FIG. 5) remain unblocked when the assembly is normally mounted against a wall.

A multi-driver ported loudspeaker system with a single enclosed volume is typically characterized by a problem of unequal acoustic impedances of the resonant enclosure as seen by the various drivers. This is typically referred to as uneven loading of drivers. Uneven loading of drivers may imply that at least one driver experiences an air pressure on its cone which is substantially different from that of other drivers at some specific frequency. Also, uneven loading may imply that one or more drivers experience air pressure that is not substantially uniform over the rear of the radiating surface of the driver, so that, for example, the pressure at one part of the cone is substantially different from that of another part.

The consequences of uneven loading of drivers are manifold. Since each driver does not experience the same sound pressure on its cone, the drivers do not work in phase and with similar magnitude, which may create a change in the overall directional characteristics or overall frequency response. More importantly, uneven loading typically leads to motion instability at high sound pressure levels which results in an early failure of driver soft parts such as the cone, the surround, and the spider. Early part failure is caused either by the nonsymmetrical air pressure on a driver which may result in nonsymmetrical cone motion of that driver or, by one or more drivers driven unstable by other drivers.

According to an aspect of the invention, the number of ports and the locations of the inner port termini are chosen so that the acoustic impedances of the resonant enclosure acting upon the various drivers are substantially the same. Using this technique overcomes the disadvantages mentioned above. Substantially even loading of drivers has been accomplished by balancing the distances from the various drivers to the various inner port termini. If nominally identical drivers are sharing the same enclosure having a single port and if the drivers are placed equidistantly from the inner port terminus, then the acoustic impedances as seen by the various drivers will be substantially the same. If the drivers share the same enclosure having more than one port opening, the location of the inner port termini are such that each driver sees substantially the same amount of port mass and box compliance.

In a typical application a minimum number of port openings is desired. Therefore, start out with one port located so as to make the distances from the inner port terminus to the drivers approximately equal. If this results in uneven loading of drivers, then add another port and again balance the port-driver distances. This procedure is repeated until a combination of number of ports and location of inner port termini has been achieved that results in substantially even loading of drivers.

The port tuning frequency is determined by the enclosure compliance and port mass. That is to say that box volume, total port cross-sectional area and port length are chosen to establish a port tuning frequency at a predetermined frequency where driver excursion becomes a minimum. The volume of each port is preferably as small as practical, flared at both input and output and of sufficiently large cross section so that port noise is substantially inaudible. The external port openings are preferably positioned on a substantially arcuate surface, thereby ensuring that the port openings remain unblocked when the assembly is normally mounted against a wall.

In the exemplary embodiment two ports are sufficient to obtain substantially equal acoustic impedances of the resonant enclosure as seen by the various drivers. The two port tubes 18 and 18' are positioned on the rear substantially arcuate surface to ensure that they are unblocked when the loudspeaker system is normally mounted against a wall.

Figure 5:
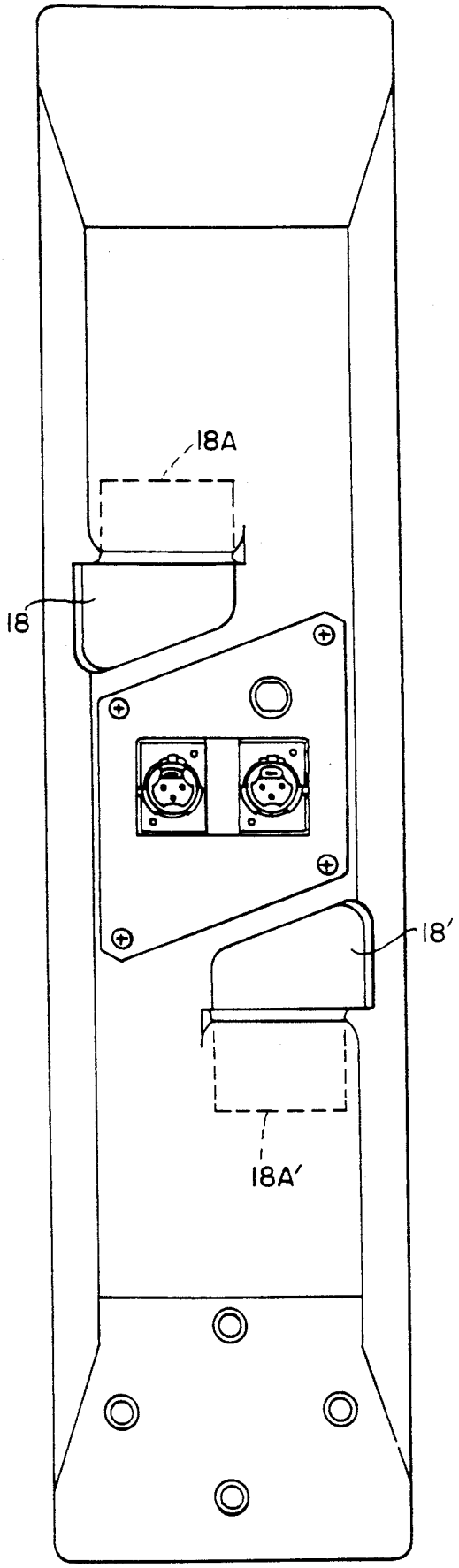

The location of the inner and outer port termini are shown in FIG. 5. As seen from the center of the loudspeaker assembly and in a rear view, the location of the inner port termini 18A and 18A' are offset vertically by about +5.1 inches and by about −5.1 inches, respectively, and offset horizontally by about −1.0 inch and about +1.0 inch, respectively. As seen from the center of the loudspeaker assembly and in a rear view, the location of the outer port termini are offset vertically by about +3.0 inches and by about −3.0 inches, respectively, and offset horizontally by about −1.0 inch and about +1.0 inch, respectively. Each port is of tapered rectangular cross section about 5.1 inches long with a cross-sectional area of about 8.5 square inches at each end and of about 7.3 square inches midway between. The port tuning frequency in the exemplary embodiment is about 140 Hz.

In the exemplary embodiment of the invention, the drivers were 4.5 inch diameter Bose HVC (helical voice coil) drivers oriented as shown in the drawings to scale with the length dimension 24 inches, the width dimension 6.5 inches and the depth dimension 8 inches.

Referring to FIG. 7, there is shown a schematic circuit diagram of a controller in this specific embodiment of the invention incorporating equalization circuitry and setting forth specific parameter values. Since those skilled in the art will be able to practice the invention by building the specific circuits shown in FIG. 7, this circuitry will only be briefly discussed to avoid obscuring the principles of the invention. Channel 1 and channel 2 are identical circuits that may, for example, receive left and right stereo input signals, respectively, in a stereo system. For a single channel, only one channel need be used to energize an associated power amplifier with the mode select switch S1 arms connected to the position 2 terminal. For voice-only reproduction, it is satisfactory and sufficient to energize the loudspeaker array with only the HF output signal with the mode select switch S1 arms connected to the position 1 terminals. For music, it is preferable to energize a separate bass amplifier energizing a separate bass reproducer, such as a BOSE 502B loudspeaker. Alternatively, an optional bass position may be selected by moving the mode select switch S1 arms to the position 4 terminals for energizing another amplifier connected to another bass reproducer, such as a BOSE ACOUSTIC WAVE CANNON loudspeaker.

While not specifically illustrated in the embodiment shown in the drawings, it is within the principles of the invention to use other techniques in combination with some or all of the techniques mentioned above, such as deflectors or reflectors. Objects larger in extent than a wavelength may be used to redirect sound from one or more drivers. Adjustable deflectors or reflectors allow the user to vary directivity.

It is also within the principles of the invention to use diffractors in combination with some or all of the techniques mentioned above. Over a limited frequency range where the drivers are larger than a wavelength, placing a small object of some predetermined shape directly in front of a driver may perturb the directivity of that driver. This approach may be used to obtain a broader radiation pattern at some frequencies. The shape of such objects may be determined experimentally.

It is also within the principles of the invention to use active electronic equalization to provide the desired frequency response.

Other embodiments are within the claims.

What is claimed is:

1. A loudspeaker system comprising a plurality of at least three loudspeaker driver assemblies each operative over a plurality of octaves in the audio frequency range and characterized by an axis and a span s, support structure supporting said loudspeaker driver assemblies in fixed substantially contiguous relationship substantially along an arcuate surface of predetermined width with the axis of each of said driver assemblies having a component perpendicular to and a component parallel to said arcuate surface with each of said driver assemblies oriented in a prescribed direction and coacting to illuminate with sound a predetermined solid angle centered at the loudspeaker system substantially uniformly over said plurality of octaves.

2. A loudspeaker system in accordance with claim I, wherein the relative positioning of said driver assemblies establishes said predetermined solid angle over a frequency range in which $\lambda$ is greater than about 1 but smaller than about 21, the curvature of said arcuate surface establishes said solid angle over a frequency range where $\lambda$ is greater than about $\frac{1}{2}$ but smaller than about 1, and the direction in which each of said driver assemblies is pointed establishes said solid angle for the frequency range where $\lambda$ is substantially smaller than about s, wherein $\lambda$ is the wavelength of a spectral component, l is the length of the array, and s is the span across a loudspeaker driver assembly.

3. A loudspeaker system in accordance with claim 2 wherein said loudspeaker driver assemblies include first and second end driver assemblies, a central driver assembly and at least first and second intermediate driver assemblies between said first and second end driver assemblies respectively and said central driver assembly, and wherein the positioning of intermediate driver assemblies establishes said solid angle over a frequency range where $\lambda$ is greater than about 2d but smaller than about $\frac{1}{2}$, wherein d is the average spacing between adjacent driver assemblies.

4. A loudspeaker system in accordance with claim 2, wherein at least one shading network is connected to some of said loudspeaker driver assemblies for establishing said solid angle for a frequency range where $\lambda$ is greater than about d but smaller than about 2d, wherein d is the average spacing between adjacent driver assemblies.

5. A loudspeaker system in accordance with claim 4, wherein said some driver assemblies consist of said end driver assemblies.

6. A loudspeaker system in accordance with claim 2, wherein the spacing between contiguous driver assemblies is the same except for a different spacing between at least two of said driver assemblies for establishing said solid angle for the frequency region where $\lambda$ is greater than about d/2 but smaller than about d by breaking up the regularity of spacing, wherein d is the average spacing between adjacent driver assemblies.

7. A loudspeaker system in accordance with claim 2, wherein said support structure comprises a ported enclosure.

8. A loudspeaker system in accordance with claim 7, wherein said ported enclosure is a resonant enclosure and has ports with inner termini located so that the acoustic impedance of the resonant enclosure as seen by a respective driver is substantially equal to that seen by each of the other drivers.

9. A loudspeaker system in accordance with claim 7, wherein said support structure has a rear concave surface normally facing a room bounding surface and formed with at least one port opening so that when said enclosure contacts a room bounding surface, each port opening remains uncovered.

10. A loudspeaker system in accordance with claim 2 and further comprising, active electronic equalization circuitry coupled to and coacting with said loudspeaker system for establishing a predetermined substantially uniform frequency response over said plurality of octaves.

11. A loudspeaker system in accordance with claim 1, wherein said support structure comprises a ported enclosure.

12. A loudspeaker system in accordance with claim 11, wherein said ported enclosure is a resonant enclosure and has ports with inner termini located so that the acoustic impedance of the resonant enclosure as seen by a respective driver is substantially equal to that seen by each of the other drivers.

13. A loudspeaker system in accordance with claim 11, wherein said support structure has a rear concave surface normally facing a room bounding surface and formed with at least one port opening so that when said enclosure contacts a room bounding surface, each port opening remains uncovered.

14. A loudspeaker system in accordance with claim 1 and further comprising, active electronic equalization circuitry coupled to and coacting with said loudspeaker system for establishing a predetermined substantially uniform frequency response over said plurality of octaves.

* * * * *